US011925275B2

(12) United States Patent
Thurner et al.

(10) Patent No.: US 11,925,275 B2
(45) Date of Patent: Mar. 12, 2024

(54) BAG AND SYSTEM FOR USE THEREOF

(71) Applicants: Annette Thurner, Irvine, CA (US); Andreas Thurner, Irvine, CA (US)

(72) Inventors: Annette Thurner, Irvine, CA (US); Andreas Thurner, Irvine, CA (US)

(73) Assignee: THURNER INC., Los Angeles, CA (US)

( * ) Notice: Subject to any disclaimer, the term of this patent is extended or adjusted under 35 U.S.C. 154(b) by 293 days.

(21) Appl. No.: 17/425,929

(22) PCT Filed: Jan. 24, 2020

(86) PCT No.: PCT/US2020/015056

§ 371 (c)(1),
(2) Date: Jul. 26, 2021

(87) PCT Pub. No.: WO2020/154663

PCT Pub. Date: Jul. 30, 2020

(65) Prior Publication Data

US 2022/0160145 A1 May 26, 2022

Related U.S. Application Data

(60) Provisional application No. 62/941,517, filed on Nov. 27, 2019, provisional application No. 62/796,993, filed on Jan. 25, 2019.

(51) Int. Cl.
*D03D 1/04* (2006.01)
*A47F 1/06* (2006.01)
(Continued)

(52) U.S. Cl.
CPC ..... *A47F 1/06* (2013.01); *A47F 9/042* (2013.01); *B65D 33/08* (2013.01); *B65D 33/165* (2013.01);
(Continued)

(58) Field of Classification Search
CPC ..... D03D 1/04; D03D 11/02; D10B 2401/12; B65D 29/00; B65D 29/04
(Continued)

(56) References Cited

U.S. PATENT DOCUMENTS 1,423,524 A 7/1922 Hill et al.
1,983,451 A * 12/1934 Gwaltney ..... D03D 3/00 139/389
(Continued)

FOREIGN PATENT DOCUMENTS

CN 101327064 A 12/2008
CN 202787813 U 3/2013
(Continued)

OTHER PUBLICATIONS

Supplementary European Search Report dated Dec. 1, 2022 issued by the European Patent Office in related European Patent Application No. 20745510.6.
(Continued)

*Primary Examiner* — Jes F Pascua
(74) *Attorney, Agent, or Firm* — Gordon Rees Scully & Mansukhani, LLP

(57) ABSTRACT

A sustainable and lightweight bag having a unique weaving pattern. A system utilizing the bag having multiple systems to provide a sustainable alternative to single use plastic bags.

18 Claims, 21 Drawing Sheets

(51) Int. Cl.

| | |
|---|---|
| ***A47F 9/04*** | (2006.01) |
| ***B65D 33/08*** | (2006.01) |
| ***B65D 33/16*** | (2006.01) |
| ***B65D 83/08*** | (2006.01) |
| ***D03D 11/02*** | (2006.01) |

(52) U.S. Cl.
CPC ..... *B65D 83/0805* (2013.01); *B65D 83/0894* (2013.01); *D03D 1/04* (2013.01); *D03D 11/02* (2013.01); *B65D 2203/06* (2013.01); *B65D 2203/10* (2013.01); *D10B 2401/12* (2013.01)

(58) Field of Classification Search
USPC ..... 383/107, 117
See application file for complete search history.

(56) References Cited

U.S. PATENT DOCUMENTS

| | | | | |
|---|---|---|---|---|
| 2,202,996 | A * | 6/1940 | Sackner | D03D 3/00 139/389 |
| 3,340,919 | A * | 9/1967 | Holbrook | B65D 29/04 139/389 |
| D264,526 | S | 5/1982 | Haft | |
| 4,328,841 | A | 5/1982 | Fontana | |
| 4,362,199 | A | 12/1982 | Futerman | |
| 2010/0008604 | A1 | 1/2010 | McIver | |
| 2012/0269463 | A1 * | 10/2012 | Nolan | A23B 7/0433 383/117 |

FOREIGN PATENT DOCUMENTS

| | | | |
|---|---|---|---|
| DE | 690 02 710 | T2 | 11/1993 |
| EP | 0 640 155 | B1 | 9/1996 |
| ES | 2 345 080 | B2 | 5/2012 |
| GB | 191314374 | A | 6/1914 |
| JP | S62-282036 | A | 12/1987 |

OTHER PUBLICATIONS

International Search Report and Written Opinion dated May 8, 2020 issued by the International Search Authority/US in a related International Application No. PCT/US2020/15056; filed Jan. 24, 2020.

* cited by examiner

BAG AND SYSTEM FOR USE THEREOF

CROSS-REFERENCE TO RELATED APPLICATIONS

This application claims the benefit of U.S. Provisional Patent Application No. 62/941,517, filed Nov. 27, 2019 and U.S. Provisional Patent Application No. 62/796,993, filed Jan. 25, 2019 both of which are incorporated by reference herein in their entireties.

GENERAL DESCRIPTION

The present disclosure relates to a bag that is reusable, transparent, lightweight, low cost, compostable, up-cyclable, recyclable, biodegradable, and systems that employ the bag.

Bags currently utilized by stores and business are frequently made of plastic and are cheap and easy to manufacture. However, these plastic bags have a negative impact on the environment. Non-compostable plastic bags may take up to 1000 years to decompose and when these bags are not properly disposed they may eventually end up in the ocean or in ecosystems in which wildlife could potentially be harmed. Conventional bags cause potential problems for the earth's ecosystem and negatively affect life on earth. Furthermore these bags are typically non-renewable. The manufacturing of these plastic bags consume resources which are non-renewable (e.g. oil). A typical alternative to these plastic bags include multi-use bags which may be heavy, expensive, and inconvenient to carry. These alternative bags may also contain toxic microplastics.

As described herein the disclosed bag and the related systems for use thereof offers sellers, distributers, buyers and consumers of groceries and other goods an alternative to environmentally unfriendly throwaway plastic or paper bags or expensive multi-use use textile (natural and/or semi-natural and/or artificial fiber) bags and other product packaging. In addition, as disclosed herein, these benefits are enhanced by the unique design of the bag including an attached/integrated identifying mechanism and its packaging.

BRIEF DESCRIPTION OF THE DRAWINGS

The features, aspects, and advantages of the present disclosure will become apparent from the following description, and the accompanying exemplary embodiments shown in the drawings, which are briefly described below.

DETAILED DESCRIPTION

Figure 1A:
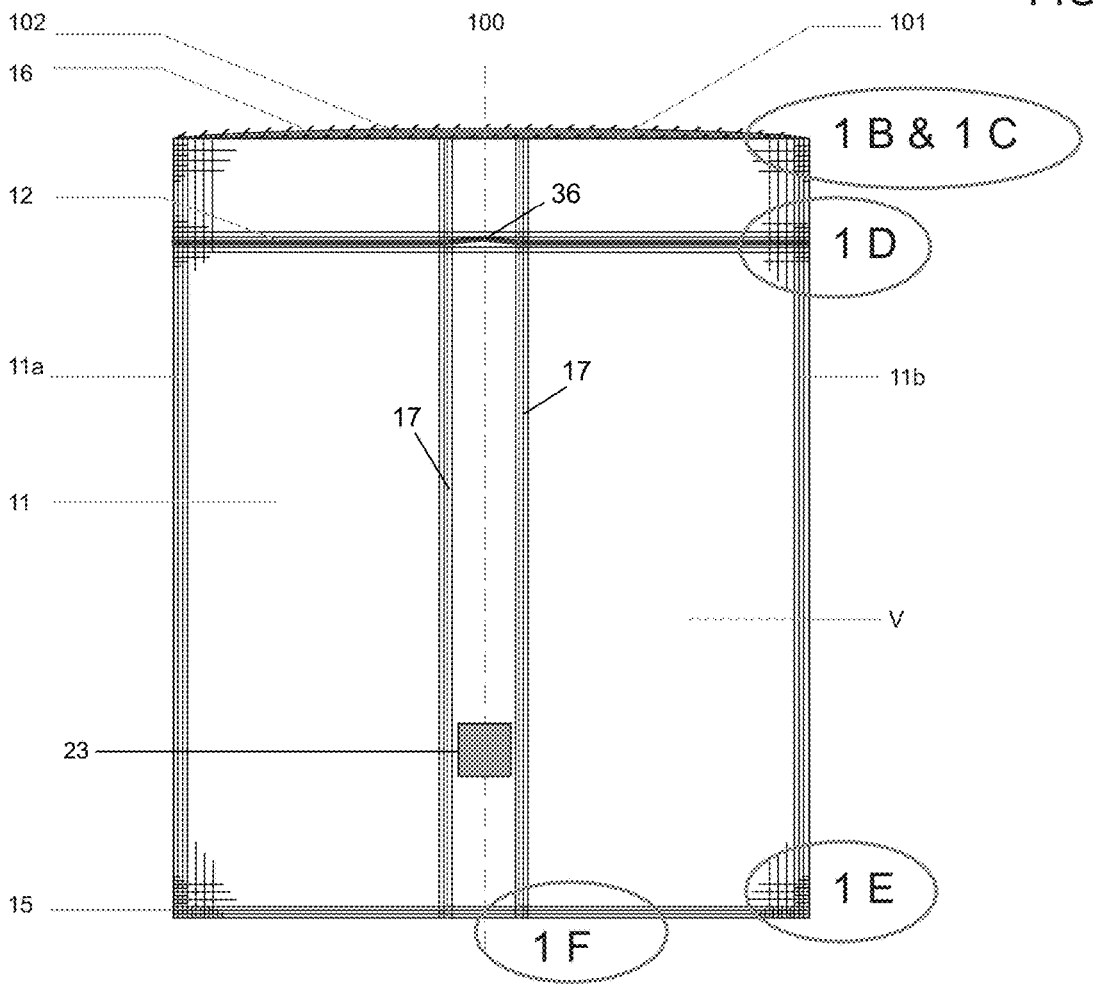
FIG. 1A is top view of an exemplary embodiment of a bag showing the bag laid flat prior to use.

The concepts and products disclosed herein could be labeled, marketed or branded by any of the following terms and/or phrases: "The Bag Project" or "EcoBag" or "Whole Bag", "Custom Bag", "Mothers Bag", "Quality Bag", "Fine Bag", "Super-Simple Bag", "Everyday bag", "Your Bag", "The goods bag", "The better bag", "In the moment bag", "Every moment bag", A ware bag", "A WARE BAG" (i.e., in German for "Ware" achtsam/wissend/bewusst sein),"Liberty Bag", "BAG—Be A Game Changer", "BAG Be A Game Changer", "Bag Changer", "Bag Changer.com", "BAG Technologies".

According to one disclosed embodiment, a lightweight reusable bag having a storage volume for holding an item is provided. The bag includes a first woven fabric layer and a second woven fabric layer defining the storage volume, an open end, and a closed end. The first woven fabric layer includes a first plurality of threads and a second plurality of threads. Wherein the first plurality of threads are interlaced to the second plurality of threads, wherein the second plurality of threads are configured to stabilize the first plurality of threads. The second woven fabric layer comprising a third plurality of threads and a fourth plurality of threads, wherein the third plurality of threads are interlaced to the fourth plurality of threads, wherein the fourth plurality of threads are configured to stabilize the third plurality of threads. Wherein the second plurality of threads of the first woven fabric layer are interlaced with the third plurality of threads of the second woven fabric layer at one side of the first and second woven fabric layer, and wherein the first plurality of threads of the first woven fabric layer is interlaced with the fourth plurality of threads of the second woven fabric layer at said one side.

According to another disclosed embodiment a reusable bag having a defined storage volume for holding an item is provided. The bag includes a first woven fabric layer and a second woven fabric layer defining the storage volume, an open end, and a closed end. The first woven fabric layer includes a first closing ribbon. The second woven fabric layer includes a second closing ribbon, and wherein the first and second closing ribbons are configured to close the reusable bag proximate to the open end.

A bag dispenser system including a plurality of bags may be utilized by providers or sellers of the bag. The bags may be releasably connected to each other at one attachment section or, in the alternative, the bags may be folded in an integrated fashion so that two sections of the bag are folded on each other and an edge of another bag is located between these sections. In addition, the disclosed embodiments relate to bags with a closure mechanism including a ribbon.

Existing bag dispenser systems include plastic bags that are rolled up in a group and then may be separated by tearing to allow individual bags to be dispensed for use. Furthermore, dispenser systems are known for towels, which are arranged so that each of the top cloth (or top towel) includes an upper portion that protrudes from an opening and is inserted with its lower end into the next cloth, so that after removal of the top cloth, the upper portion of next cloth protrudes out of the opening of the box in a position ready to be grasped for use.

Presently, sustainability plays an important role in many areas of life and is correspondingly desired and demanded by a majority of the population. The demand for sustainable products also applies in particular for the packaging of goods (e.g., clothing or food). For this purpose, typically plastic bags have been provided in shops, which may be torn off either by rolls or from containers in which these are simply superimposed, removed and/or may be demolished. However, due to the increasing importance of sustainability there is a need to provide bags in stores that are made of sustainable material and that may be easily dispensed to customers for use from a roll or a storage box.

Against this background, an object of the disclosed embodiments, is to provide a bag dispenser system, as well as bags made of a braided, knitted or woven material with a closure mechanism to provide a simple and sustainable way to provide sustainable bags.

According to one disclosed embodiment, a bag dispensing system is provided that includes a plurality of bags, wherein the bags are each releasably connected to each other at a fixing portion, and wherein each bag is formed of a material of natural fibers, in particular a textile material or a paper material. According to the dispensing system, the user may remove the bags individually and the bags are compostable or are otherwise biodegradable or otherwise reusable and/or recoverable.

The bags of the bag dispenser system may be rolled up into a roll. The roll provides a space-saving possibility of storing the bags created.

In one disclosed embodiment, the releasable attachment of the bags of the bag dispenser includes a perforation, a releasable bonding or a detachable seam. Perforations, releasable bonds, releasable seams, and the like provide an efficient way of separating the bags and removal of the bags from the dispensing system without the need for the user to expend significant force separating retrieving the bags.

According to a another disclosed embodiment, a bag dispenser system is provided that includes a plurality of bags, the bags each being folded so that two portions of the bags are folded together and one edge of a bag another bag lies between these sections, each bag being made of a material of natural fibers, in particular a textile material or a paper material, or of a plastic material, in particular a plastic fiber material. The user may remove the bags one at a time out of the bag dispensing system and use them, the bags being compostable or otherwise biodegradable or otherwise reusable and/or recoverable.

Further, the successive folded bag of the bag dispenser system may be housed in metal, cardboard or wood in a box. The manufacture of the box from these materials gives the box sufficient durability. In addition, these materials are also compostable or otherwise biodegradable or otherwise reusable and/or recoverable, so that sustainability of both the bags and the dispensing or storage box.

Preferably, each bag of the bag dispenser system is configured to include a grip hole. Thus, the bag can be both easily filled and handled by the user. Also, at least one edge of each bag may be made with a seam made of natural fibers. The hem of natural fibers is also compostable or otherwise biodegradable, so that the bag in its entirety is sustainable.

The bags may be semi-transparent. Through the semi-transparency of the bags, the contents of the bag be easily seen without opening the bag.

In a further embodiment each bag may have a bar code/point code QR Code/Barcode/RFID Technology or other which may be applied using environmental friendly ink. By means of a barcode/point code the bags may be read in and the data may be further processed. In addition, the bags are also compostable with barcode/dot code or otherwise biodegradable or otherwise reusable and/or recoverable.

The bags are preferably food safe. When food is poured into conventional plastic bags, there is a possibility that particles of the bags may enter into and mix with the food. The bag material may be harmful to human health and should be avoided. Thereby, the bags disclosed herein are food safe, such that any particles that may pass from the bags to the food contained therein, no danger to the people.

Furthermore, the bag may preferably be resistant to tearing. Even if heavy items or food stored in the bags and the tearing resistance ensures that the bags may withstand the load.

In a further embodiment, the bags of the bag dispenser system are each formed from a single sheet of material. Such a configuration of the bags considerably simplifies the production process of the bags. Thus, costs and time may be saved.

Each bag of the bag dispensing system may be formed of two layers and at least one edge of one part by bonding and/or sewing to be connected to one edge of the other part. The method of production is particularly suitable for bag materials which may be produced from a tube or other technology, and is also time and cost saving.

The bags may be formed from a braided, knitted or woven material. These materials, due to their special structure, represent a particularly robust composite material that can withstand moisture and support weight loads without incurring significant damage.

Preferably, each bag is made of a pressed material. Pressed material is easy to manufacture and leads to a time-saving and cost-saving production of the bags. The bags may also be formed in a rectangular shape. This also increases the efficiency in the production of the bags.

The bag may be made of a woven, knitted or woven material, each bag having a closure mechanism including a ribbon introduced into the weave, wherein the ribbon is alternately pulled under at least one warp thread and at least one adjacent warp thread, wherein the closure mechanism has at least one engagement portion which is formed by a weave pattern, in which the ribbon under each pulled first warp thread and pulled over at least three subsequent warp threads. Such a closure mechanism provides a non-positive locking device, and easy-to-use closure, for the bag. In addition, the closure mechanism is easy to open again after closure.

According to another embodiment, a reusable bag is provided having a defined storage volume for holding an item including a first woven fabric layer and a second woven fabric layer defining the storage volume, an open end, and a closed end. The first woven fabric layer includes a first closing ribbon; the second woven fabric layer including a second closing ribbon, and wherein the first and second closing ribbons are configured to close the reusable bag proximate the open end.

According to another embodiment, a reusable bag is provided having a defined storage volume for holding an item including a first woven fabric layer and a second woven fabric layer defining the storage volume, an open end, and a closed end. An identifying mechanism for carrying data associated with an item stored in the bag and/or identification of the bag, and wherein the identifying mechanism is integrated and/or attached to the bag.

According to another embodiment, a network employing the bag is provided. The network may include an online module including one or more physical servers. A local module may be provided that includes a display, a processor, and a memory. A reusable bag having an identifying mechanism including bag identification data wherein the local module is configured to assign bag information data, via the processor, associated to the reusable bag, wherein the bag information data includes data associated with an item stored in the bag, and a user of the bag, and wherein the bag identification data and bag information data is stored in the online module and is configured to be displayed to the display of the local module. A mobile device may be configured to communicate with the online module in order to display the bag identification data and bag information data to a display of the mobile device, wherein the local module, via the processor, assigns the bag identification data to a user data of the user, and wherein the online module stores the user data.

According to another embodiment, a delivery system is provided utilizing the network as discussed above. The delivery system includes an online module configured to communicate with an electronic device receiving input from a user. The online module may include one or more physical servers a product holder in communication with the online module, and wherein the product holder receives an order request sent by a user, wherein packaging of the order is directly modified by the user.

According to another embodiment, a recycling system may be provided. The recycling system may include an online module including one or more physical servers, a local module including a sensor, a reusable bag having an identifying mechanism including bag identification data. The local module may be configured to read the bag identification data, via the identifying mechanism, associated to the reusable bag, wherein the bag information data includes data associated with an item stored in the bag, and a user of the bag. The local module further includes a recycling container configured to receive the reusable bags discarded by the user, wherein the online module is configured to be accessed by the user via an electronic device; and wherein the local module communicates with the online module to provide rewards, via the electronic device, to the users of the associated reusable bags discarded and received by the recycling container.

According to another embodiment, a bag stand is provided. The bag stand is configured to hold and dispense reusable bags. The stand may include a dispenser that includes a first storage volume surrounded by a first, second, third, and fourth walls wherein at least one of the first, second, and third wall comprises a cutout configured to aid in grabbing of the bags and wherein the first wall comprises a logo and an identification mechanism (QR Code/Barcode/RFID Technology or other) associated with the logo.

The features described above according to the different aspects of the disclosed embodiments may advantageously be combined to form the bag with any possible combination of features. As described herein is a lightweight bag and system for using the bag as a sustainable alternative to single-use plastic bags. The bag and its system provides an alternative to plastic bag usage. Through the bag's light construction, the bag opens a new category of bags which offer sustainability and convenience. The bag and system allows the users of the bag to be ecofriendly with minimal changes in their lifestyle or operations. One function of the bag is to replace single use plastic bags without a change of behavior of the customer but offering the same of even higher convenience. The bag provides to the users a high quality experience and the appearance of the bag inspires users to use the bag multiple times. The system provides opportunities to re-/up-cycle. The bag is also capable of safe, clean, and complete composting. The bag and the system also provides an open advertisement platform on bag and on the system which may utilize online platforms such as social media and video hosting services. The bag and the system offers an attractive incentive plan for stores and users of the bag. The design and construction of the bag utilizes very little material and while still enabling strength and stability to carry goods such as food, grocery, clothing, hygiene material, cosmetics, toys (e.g. LEGO), trash or other. The bag is the light (100% renewable natural raw material), efficient to manufacture, and sustainable. The manufacturing and distribution process of the bag is highly optimized in terms of carbon footprint. The low weight of the bag allows easier and more efficient distribution of the bag, thus enabling a low carbon footprint for the bag.

The bag may be manufactured with, for example, Fairtrade or Global Organic Textile Standard (GOTS) certified materials. The disclosed bag may be 100 percent organic and may be fully compostable. The bag is recyclable, up-cycable, reusable, washable and contains no added chemicals or other additions which could compromise food and environmental safety. The material may be, but is not limited to, any nature natural fabric such as cotton, hemp, or the like. These materials offer an advantage in that they may be naturally grown and harvested, replanted. Minimal amount of material is used when manufacturing the bag. Less material results in lower resource requirements such as lower transportation costs, lower manufacturing time, easier to decompose. The bag offers an optimized balance of lightness, quality, stability, and robustness.

FIG. 1A shows a bag 11 with an upper end 16 and a lower end 15. The upper end 16 may be open while the lower end 15 may be closed. The bag 11 is configured to receive an item configured to be stored in the bag 11. Items may include various objects such as common grocery items (e.g. fruits, vegetables, etc.), canned goods, cooked or baked goods, frozen goods, clothing, hygiene material, cosmetics, toys, etc. The bag 11 includes a first woven fabric or fabric layer 101 and a second woven fabric or fabric layer 102 that together define a storage volume 'V' configured to hold various items. The first woven fabric 101 and second woven fabric 102 may overlap each other. The first and second woven fabrics 101/102 may be interwoven or interlaced to each other at the lateral sides 11*a*, 11*b*, and lower end 15 of the bag.

Figure 1B:
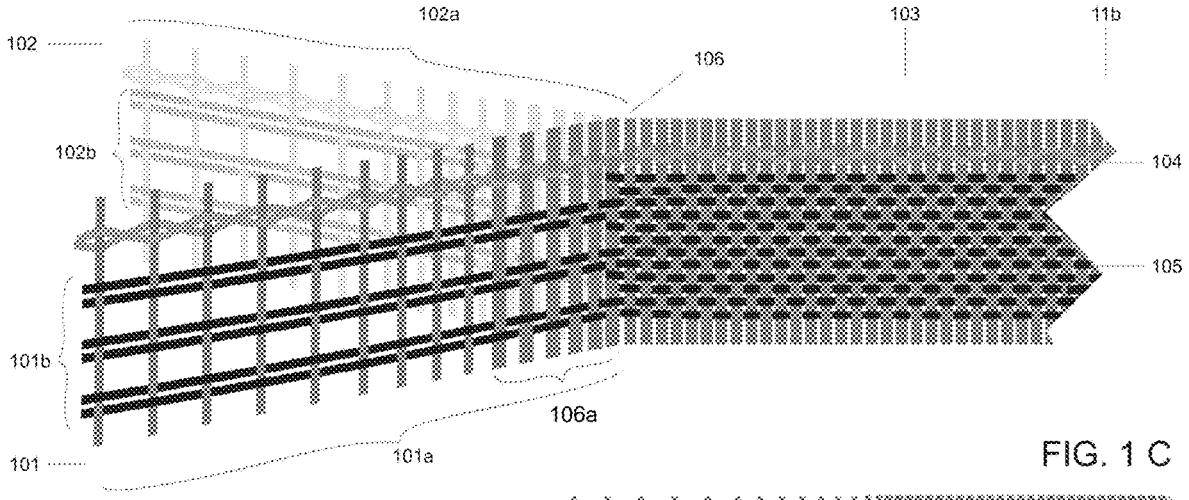
FIG. 1B is a close up of the top right upper portion of the bag in FIG. 1.

The first and second woven fabrics 101/102 may be transparent. The density of the weave may be between 42% air or open and 58% fabric to 72% air or open and 28% fabric per $cm^2$ (inclusive). Density as described herein is the percentage of empty space and material per area in one of the fabric layers 101/102. Thus a woven fabric layer with 42% air and 58% fabric represents, in a given area, the fabric layer comprising only 58% of a material (e.g. fabric, thread, yarn, etc.). A majority of the weave of the woven fabric layers 101/102 may be made of 72% air and 28% fabric per $cm^2$. The density of the weave may vary throughout different parts of the fabrics 101 and 102. The density of the woven fabrics 101 and 102 may decrease towards the lateral center 100 of the bag 11 as shown in FIGS. 1A and 1B.

The first woven fabric 101 includes a first plurality of threads 101*a* and a second plurality of threads 101*b* that is configured to stabilize the first threads 101*a*. The second woven fabric 102 includes a third plurality of threads 102*a* and a fourth plurality of threads 102*b* that is configured to stabilize threads 102*a*. The first and second fabrics 101/102 are configured to be interwoven at the lateral sides 11*a* and 11*b* such that the second threads 101*b* of the first fabric 101 is interlaced with third threads 102*a* with the second fabric 102. Likewise, the first plurality of threads 101*a* of the first woven fabric layer 101 is interlaced with the fourth plurality of threads 102*b*. The interlacing of the first, second, third, and fourth threads 101*a*/101*b*/102*a*/102*b* creates an interwoven area 103 that provides holding strength and rigidity to the bag and defines the storage volume 'V' at three sides.

First and third threads 101*a*/102*a* may be longitudinally extending (i.e. extends along the length of the bag, also known as warp threads). Second and fourth threads 101*b*/102*b* may extend laterally (i.e. extends along the width of the bag, also known as weft threads). The first and third threads 101*a*/102*a*, for example, may be orthogonal to the second and fourth threads 101*b*/102*b*, however other configurations may be made in order to interweave the first and second fabric layers 101 and 102. The disclosed weave configuration allows the first threads 101*a* and third threads 102*a* to stabilize the second and fourth threads 101*b* and 10*b* respectively. Compared to a seam, the configuration as discussed above would hold larger loads and is more resistant to being unraveled or pulled apart.

Figure 1C:
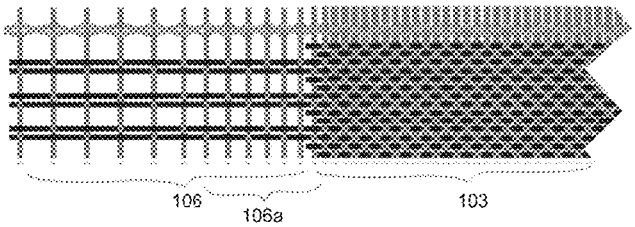
FIG. 1C is a close up of the right upper portion of the bag in FIG. 1.

The first and second fabric layers 101 and 102 may be manufactured at the same time such that the weaves for the first fabric layer 101 and second fabric layer 102 are created together, simultaneously. Thicker longitudinal threads may be used in the interwoven area 103 as shown in FIGS. 1C and 1E at lateral side 11*b*. The bag may also include an identifying mechanism 23, which may be a QR Code, a barcode, or passive/active RFID or the like. Position of the identifying mechanism 23 may vary and is not limited to the position shown as FIG. 1A. For example, the identifying mechanism 23 may be included in the second fabric layer 102, or may be positioned in the corner of the bag, or positioned at the center of the bag.

At the interwoven area 103, the fabric layers 101 and 102 become integrated and first and third threads 101*a*/102*a* may be overlapping each other. The first and third threads 101*a* and 102 may also be separate and configured to be disposed in an alternating pattern at the interwoven area 103 (i.e. only a single longitudinal thread per longitudinal line). As shown in FIGS. 1B and 1C, the first and third plurality of threads 101*a* and 102*a* may include a plurality of spaced thread pairs. Each thread in each pair may be parallel and spaced such that the first and second fabric layers 101 and 102 are complimentary to each other such that the spacing of the first plurality of threads 101*a* is offset to the third plurality of threads 102*a*. Other known patterns that provide a rigid transparent weave may be utilized for fabric layers 101 and 102.

A leno weave 104 may be woven into the lower end 15 and/or the upper end 16 of the bag 11. The leno weave 104 provides additional stability and strength to the weave. The leno weave 104 in addition to the interwoven area 103 allows the bag to hold up to approximately 3-4 Kg in weight in the storage volume or pouch. After the interwoven area 103, the leno weave splits and follows the corresponding fabric layers 101 and 102 at the start of the transition portion 106 as shown in FIG. 1C. The bag may be labeled with the designed weight capacity in order for the user to be informed about proper use of the bag and to prevent unintended damage to the bag by overloading the bag. The bag as shown includes woven fabric layers 101 and 102, however any number of additional woven fabric pieces may be added to the bag in order to create different bag shapes and sizes.

Fabric density of layers 101 and 102 is configured to be such that the layers are transparent. The density of the weave may be between approximately 42% air and 58% fabric to approximately 72% air and 28% fabric (inclusive). The bag may take on different shapes and sizes. The low density of the weave allows for less material cost and overall competitive pricing against competitors. The bag at most will weigh no more than 12.5 g. A zig-zag pattern 105 is shown on the lateral side 11*b*, however, other patterns or shapes may utilized for different bag designs. The weave on the lateral side 11*b* as shown in FIG. 1B-1E at the interwoven area 103 may comprise a density of, for example, 42% air and 58% thread per $cm^2$.

The density of the weave may decrease as a function of lateral position of the weave layer. The density of the weave may decrease towards the center of the bag. As shown in FIG. 1C the first and second fabric layers 101 and 102 may include a transition portion 106 where density of the weave decreases towards the center of the bag. For example, the weave density of the interwoven area 103 may be about 42% air and 58% fabric on the lateral side 11*b* as shown in FIG. 1B-1E. The weave density may gradually decrease to about 78% air and 28% fabric towards the center of the bag, where this density (78% air/28% fabric) will represent a majority of the fabric layer 101 and 102. While only the right lateral side 11*b* is shown, similar configuration may also be applied to left lateral side 11*a*, thus the bag may include a symmetrical configuration for both sides 11*a* and 11*b* relative to the center 100.

Figure 1D:
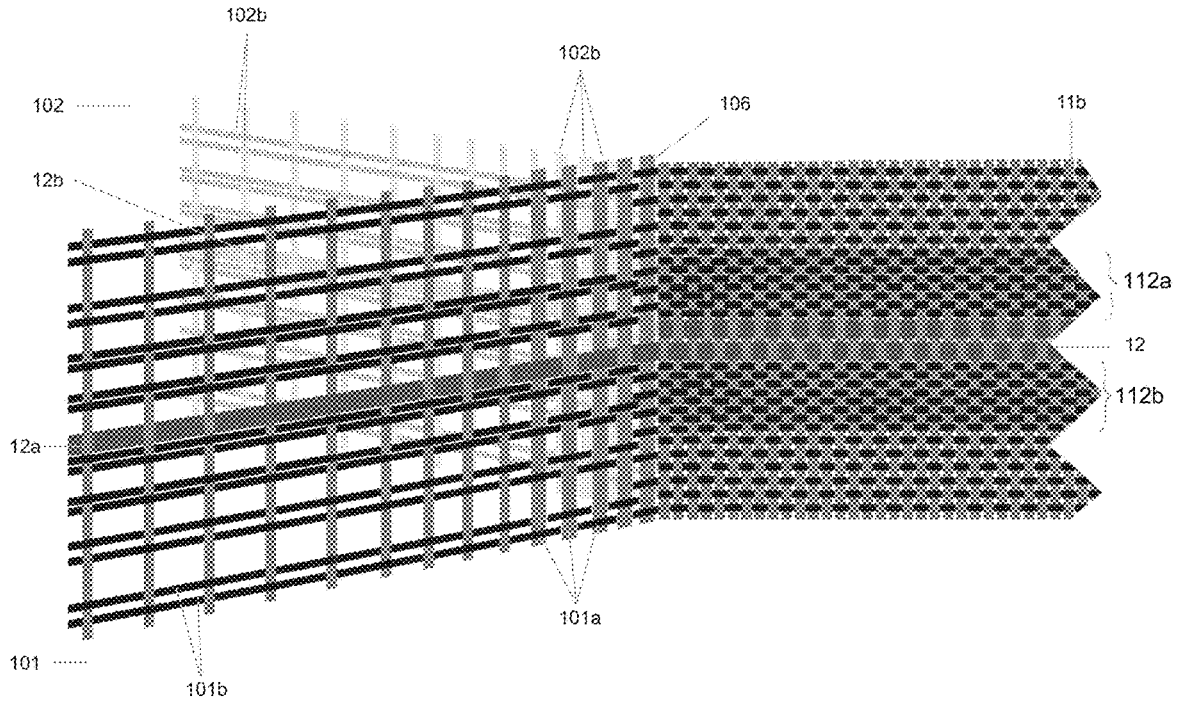
FIG. 1D is a close up of the closing mechanism of the bag in FIG. 1.
Figure 1E:
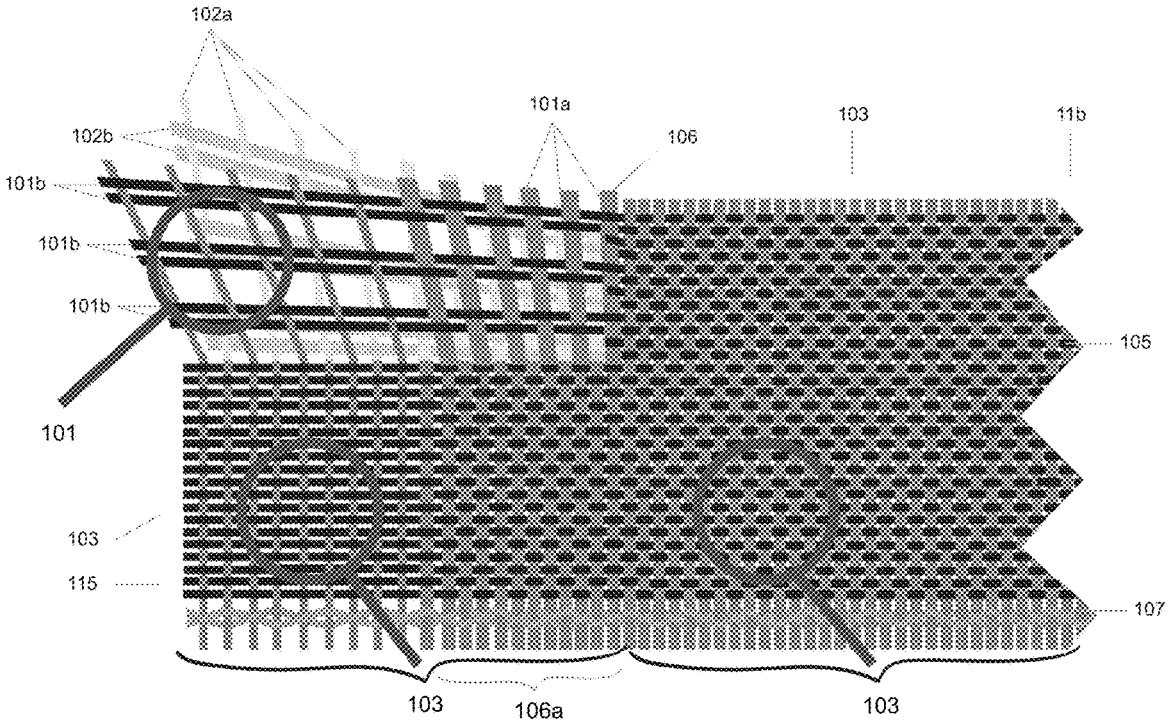
FIG. 1E is a close up of the right lower portion of the bag in FIG. 1.

FIG. 1D shows closing ribbon 12 interwoven into the first and second fabric layers 101 and 102. As an integral part of an innovative, unique, customer-friendly, low-cost bag a convenient closing ribbon 12 is integrated into the weave and within one process step as part of the weaving process of the bag. The closing ribbon 12 is exposed on two sides (e.g. on the first and second fabric layers 101 and 102). By pulling on the ribbon 12, on both sides simultaneously the storage volume 'V' of the bag may be closed off and remains closed until the bag is manually opened. The bag may be closed and opened several times. The bag may be weaved as a unitary tube having the first and second fabric layers 101 and 102. The closing ribbon is interwoven and integrated in one automated operation in the tube weave design. The disclosed manufacturing process is preferred in order to enable the bag to be produced and sold at a relatively low cost. The closing ribbon 12 is stronger, thicker, and may be differently colored or in any other way identifiable relative to the other threads in the bag. The ribbon is interwoven within the bag and exposed in two areas on the outer side of the bag. The ribbon may also be interwoven to the longitudinal threads (i.e. interwoven to the first and third plurality of threads 101*a*/102*a*). The ribbon may also run parallel to the transverse threads (i.e. parallel to the second and fourth plurality of threads 101*b*/102*b*). An engagement region 36 of the bag as shown in FIG. 1A allows the ribbon to be pulled.

The closing ribbon 12 is configured to close the bag at the location shown in FIG. 1A. Each fabric layer 101 and 102 includes a corresponding closing ribbon 12*a* and 12*b* respectively. The ends of closing ribbons 12*a* and 12*b* may be knotted to each other such that both ribbons 12*a*/12*b* form a closed loop. The ribbons 12*a* and 12*b* may also be unitary and looped onto each other such that the ribbons 12*a* and 12*b* cannot be completely pulled away from the weave (i.e. completely separate the ribbons 12*a*/12*b* from the bag). Different methods of joining the ribbons 12*a* and 12*b* may be used such as sewing, gluing, or any other fixing/attaching methods to prevent the ribbon from being pulled completely away from the weave. The ribbon is configured to be integrated into the bag, allowing the ribbon to be a carrying mechanism for the bag 11.

The ends of ribbon 12 may also be thickened at the interwoven area 103 to stabilize the interwoven area 103. The ends of ribbons 12*a* and 12*b* may also be knotted in order to stabilize the interwoven area 103. A link weave may also be integrated into the weave at two sides in order to stabilize the interwoven area 103. Higher density sections 112*a* and 112*b* may be disposed adjacent to the closing mechanism 12 at the interwoven area 103. Higher density sections 112*a*/112*b* represents a section of the weave wherein the transverse weaves 101*b*/102*b* are spaced closer than the adjacent area. Reducing the spacing between transverse threads 101*b*/102*b* in each fabric layer 101 and 102 allows the higher density sections 112*a* and 112*b* stabilize the actuation of the closing mechanism 12. The increased density extends across the bag laterally from both sides 11*a*/11*b*, thus extending parallel with the closing mechanism 12.

An advantage of the disclosed embodiments, is the simple scalability of the manufacturing. The bag may be produced in large scale and highly automated, machined and in one single operation. The process step of cutting might be a secondary process step. The bag may be woven in one "endless" pattern—e.g., a tube or a band. For example, the bag may be formed in a "one-piece woven" process. The simple manufacturing process and scalability provides a significant advantage because the bag should be producible by different manufacturers worldwide in order to keep transport and the carbon footprint very small. The bag 11 may be used to replace single-use bags but is not limited to single use embodiments. The bags may be used as trash bags, bags for any other goods like food, hygiene, toys, cloth, storage or other products.

FIG. 1E shows the lower end 15 of the bag 11 at the lateral side 11*b*. A lower leno weave 107 is interwoven onto the longitudinal threads 101*a*/102*a* at the lower part of the longitudinal threads. The interwoven area 103 may extend to the lower end 15 and further extends to left lateral side 11*a* (not shown in the figure). At this lower interwoven area 103 below the storage volume 'V', the weave density may transition from about 42% air and 58% fabric on the lateral side 11*b* to about 55% air and 45% fabric per $cm^2$ towards the center of the bag. The transition portion 106 may also include a thick portion 106*a* which includes threads thicker than the surrounding area. Thus, at the interwoven area the longitudinal thread 101*a*/102*a*, the thread may include thread having a first thickness. At the thicker transition portion 106*a* longitudinal thread 101*a*/102*a* may include threads having a second thickness. At the center 100 of the fabric layers 101 and 102, longitudinal yarn may include threads having a third thickness. The thickness of the longitudinal threads may be different at different portions of the bag. For example the first thickness may be larger than the third thickness and the second thickness may be larger than the first thickness. In other words, longitudinal threads 101*a*/102*a* may be thickest at the transition portion, and then second thickest at the interwoven area 103 on its lateral sides 11*a*/11*b* and least thick for the rest of the fabric layer (e.g. towards the center of the bag/fabric layers 101/102). Alternatively, the longitudinal threads 101*a*/102*a* found in the transition portion 106 may include threads of the same thickness as the interwoven area 103 at the lateral sides 11*b* and 11*a*. The configuration of variable thicknesses as described above allow for better stabilization of the weave of the bag 11.

Figure 1F:
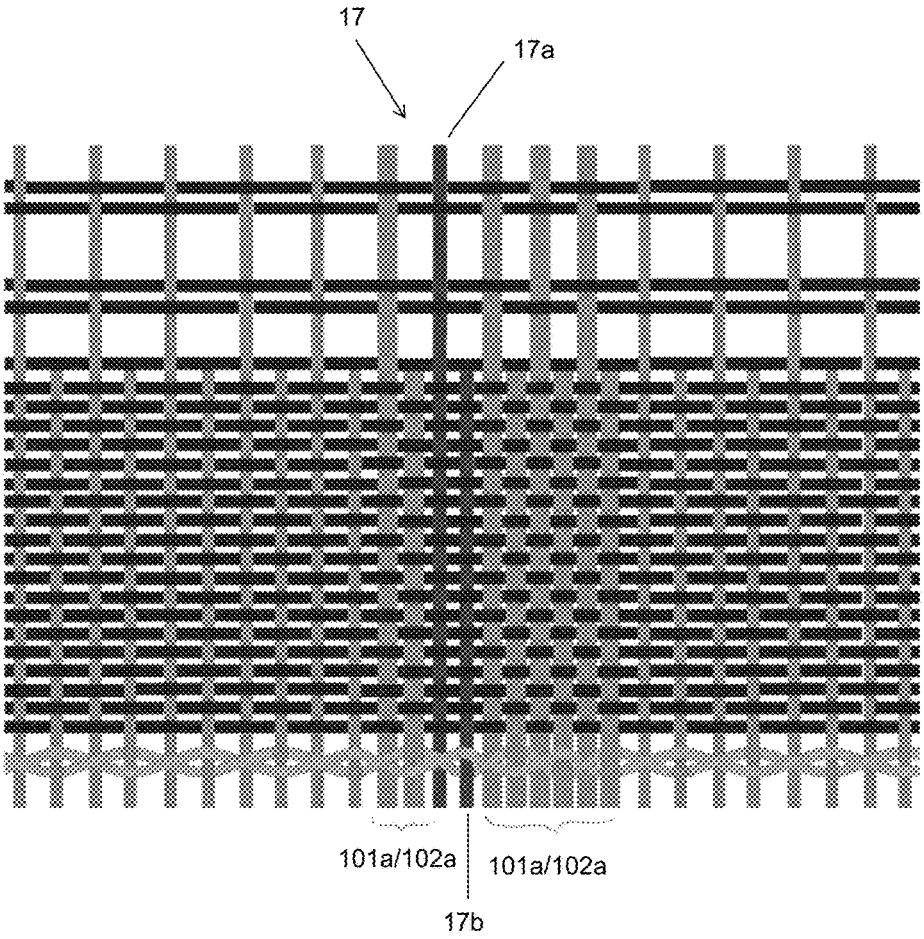
FIG. 1F is a close up of the center lower portion of the bag in FIG. 1.

FIG. 1F shows a close up of the lower portion 15 near the center of the bag 11. The bag may include an indicator 17 comprising a first indicator thread 17*a* and second indicator thread 17*b*. The indicator 17 allows the user of the bag to easily identify the engagement region 36 of the closing mechanism 12. This indicator runs longitudinally along the bag. Longitudinal threads 101*a*/102*a* may be thicker near or adjacent the indicator 17 in order to stabilize the indicator threads 17*a* and 17*b*. The indicator may be colored differently than the adjacent weave structure. Indicator thread 17*a* extends and is interwoven into the first fabric layer 101, and indicator thread 17*b* is interwoven and extends to the second fabric layer 102.

Referring now to FIGS. 1G-4, a bag dispenser system 10 comprising a plurality of bags 11, said bag 11 respectively to a fixing portion 13 detachably connected to each other, wherein each bag 11 made of a material of natural fibers, in particular a textile material or a paper material is formed. German Utility Model No. 20 2015 005 114.6 discloses an exemplary dispensing system and is incorporated by reference herein in its entirety.

Figure 1G:
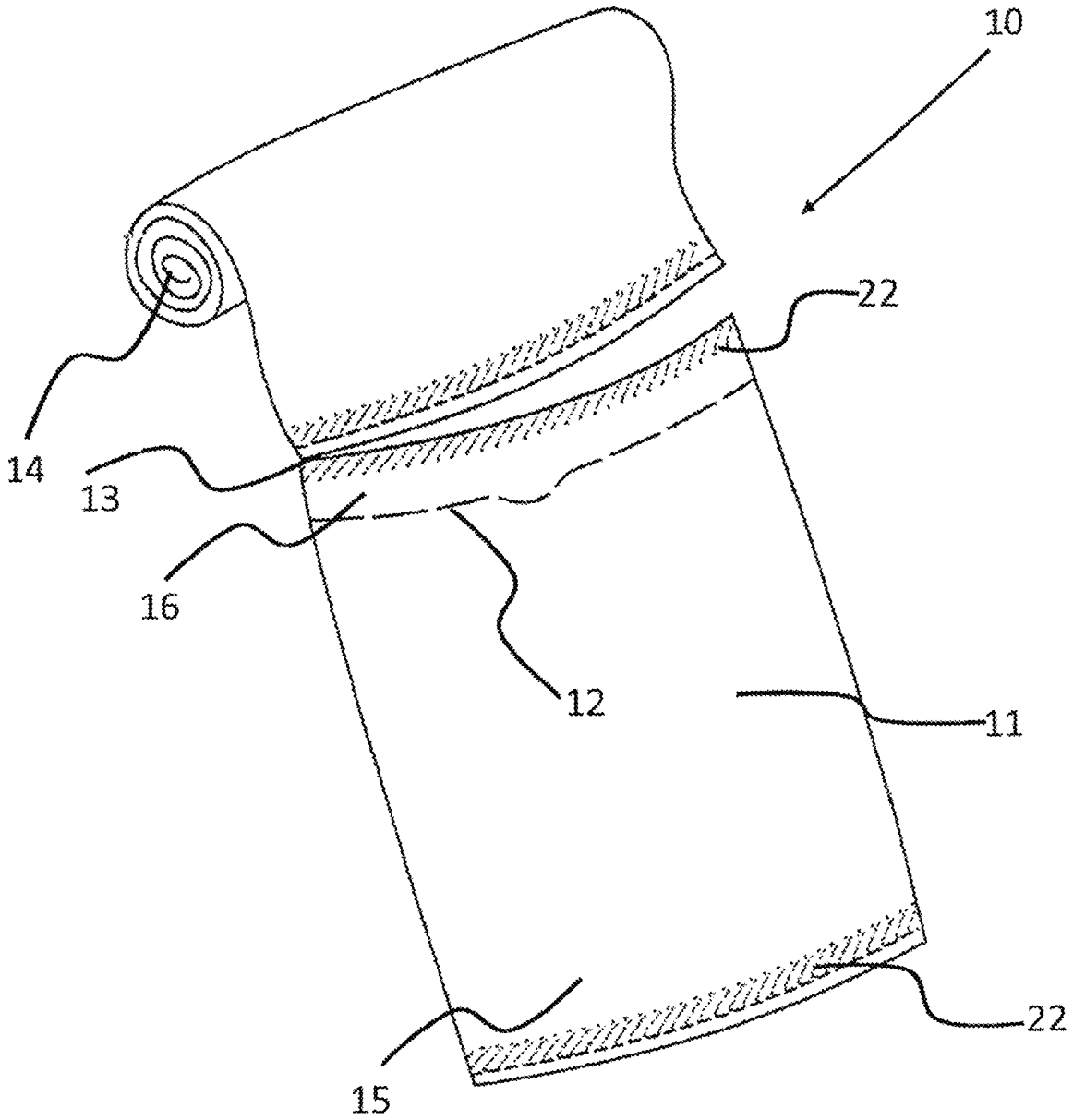
FIG. 1G shows a system for providing a plurality of bags.
Figure 1H:
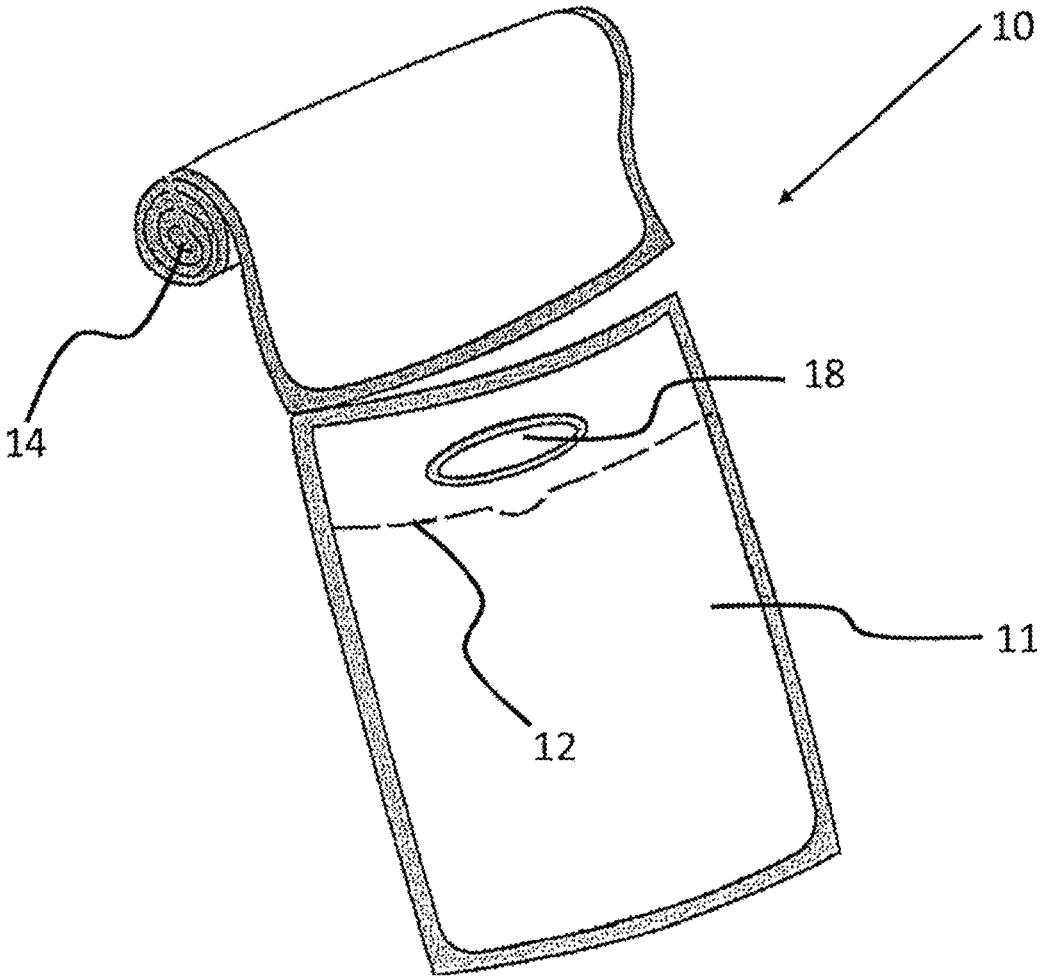
FIG. 1H is an alternative embodiment of a bag.
Figures 2, 2A:
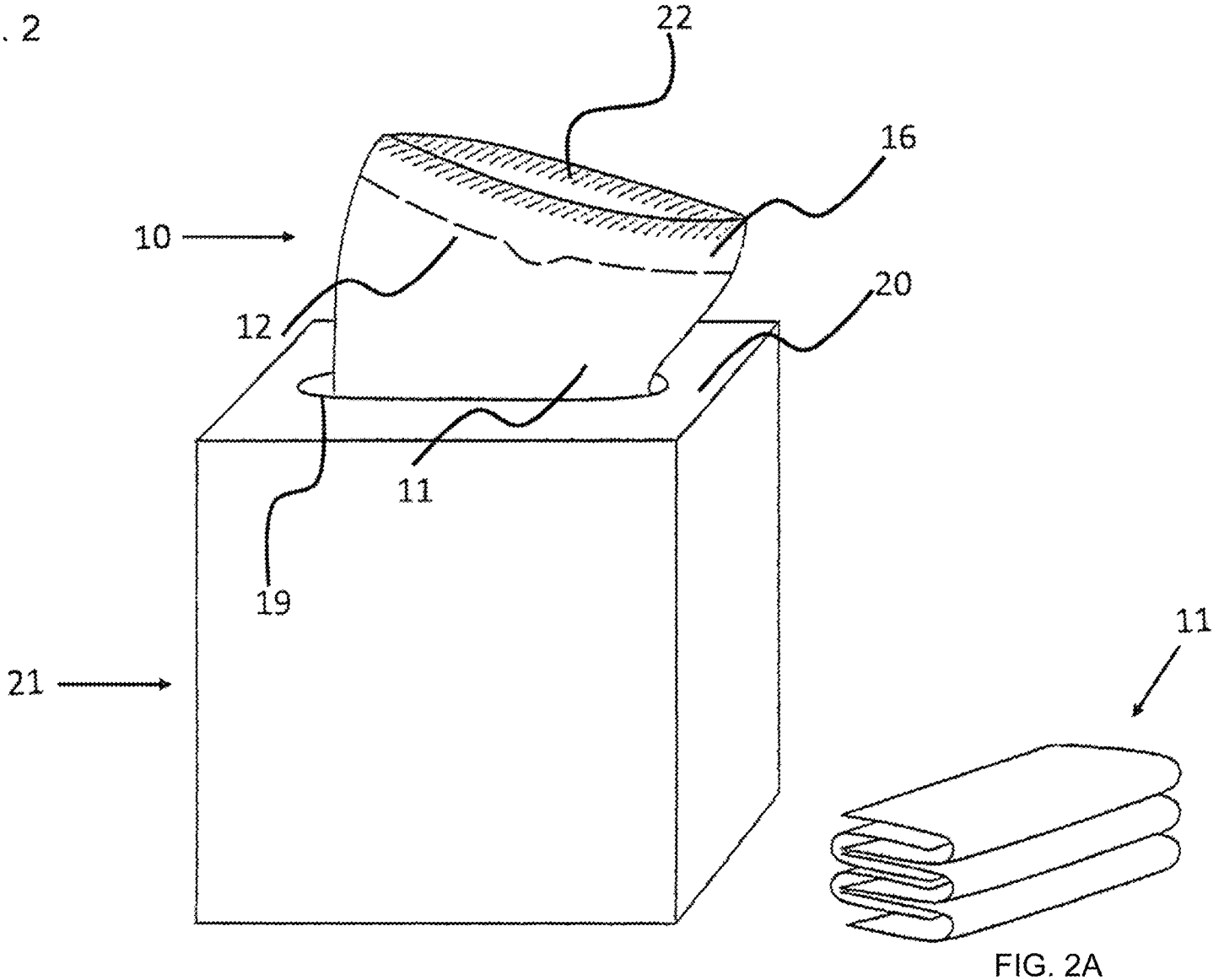
FIG. 2 is a bag dispensing system.
FIG. 2A shows a plurality of bags in a folded state.
Figure 3A:
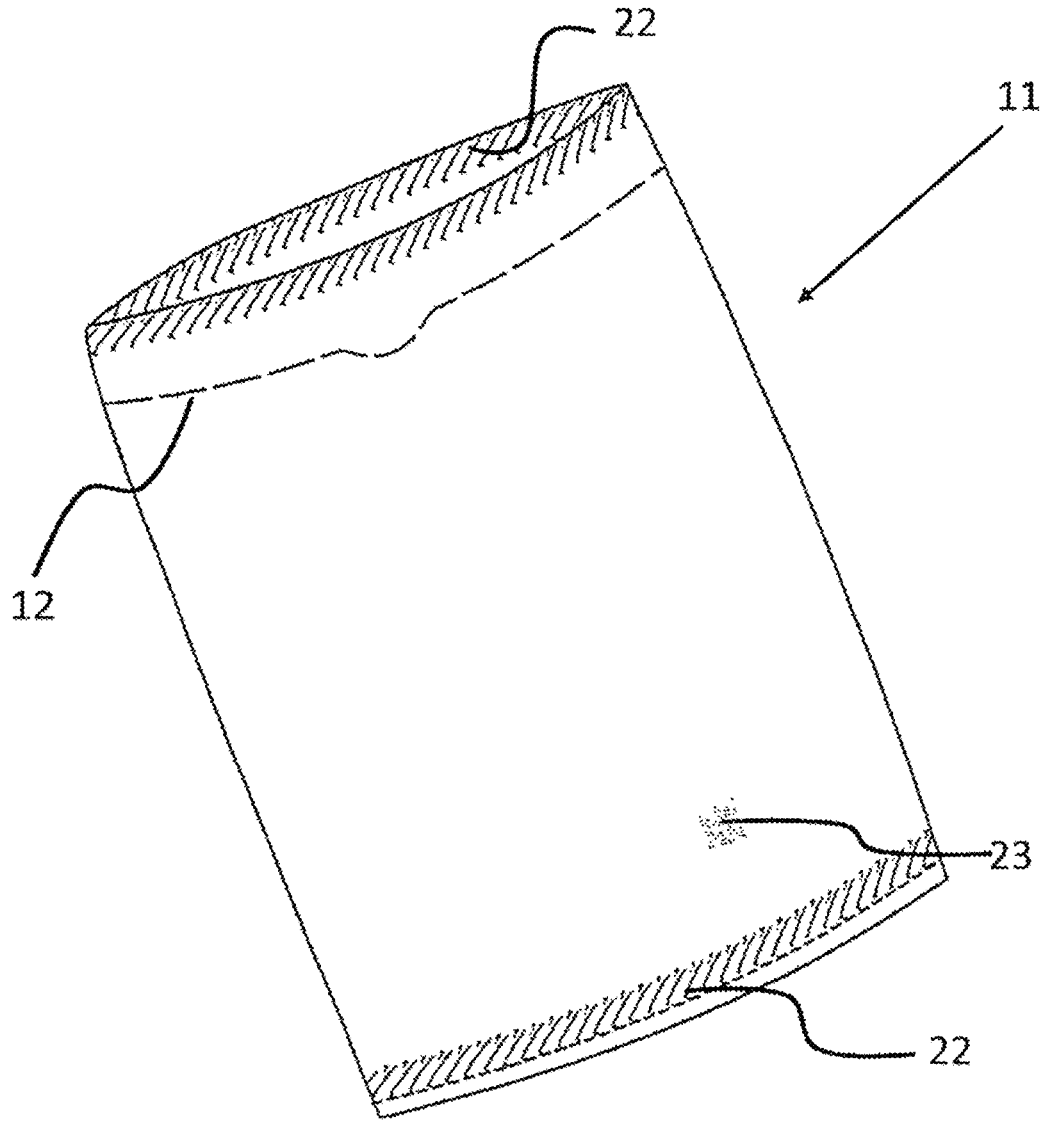
FIG. 3*a* is an embodiment of a bag having an identifying mechanism.
Figure 3B:
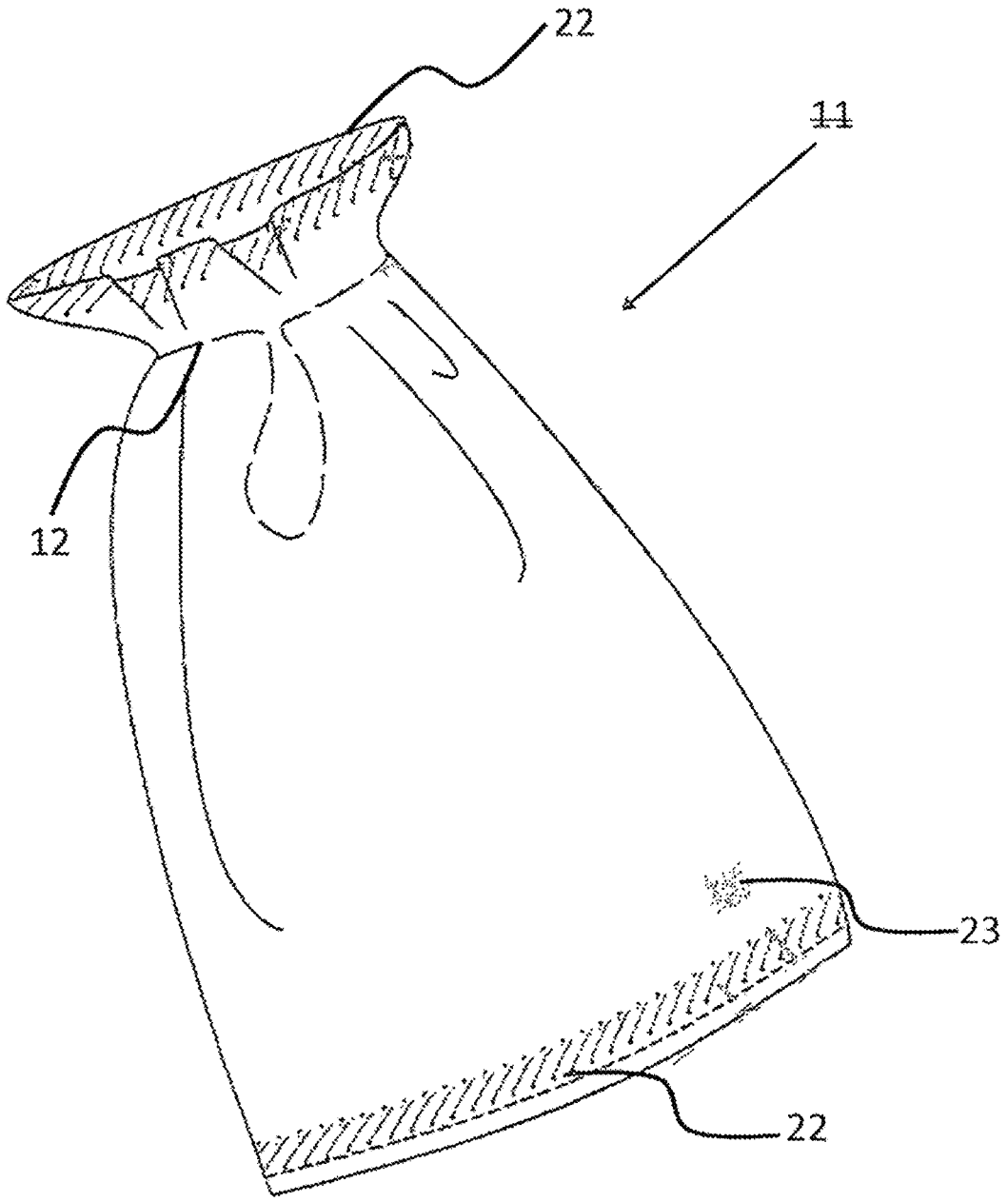
FIG. 3*b* is the bag in FIG. 3A with an actuated closing mechanism.
Figure 4:
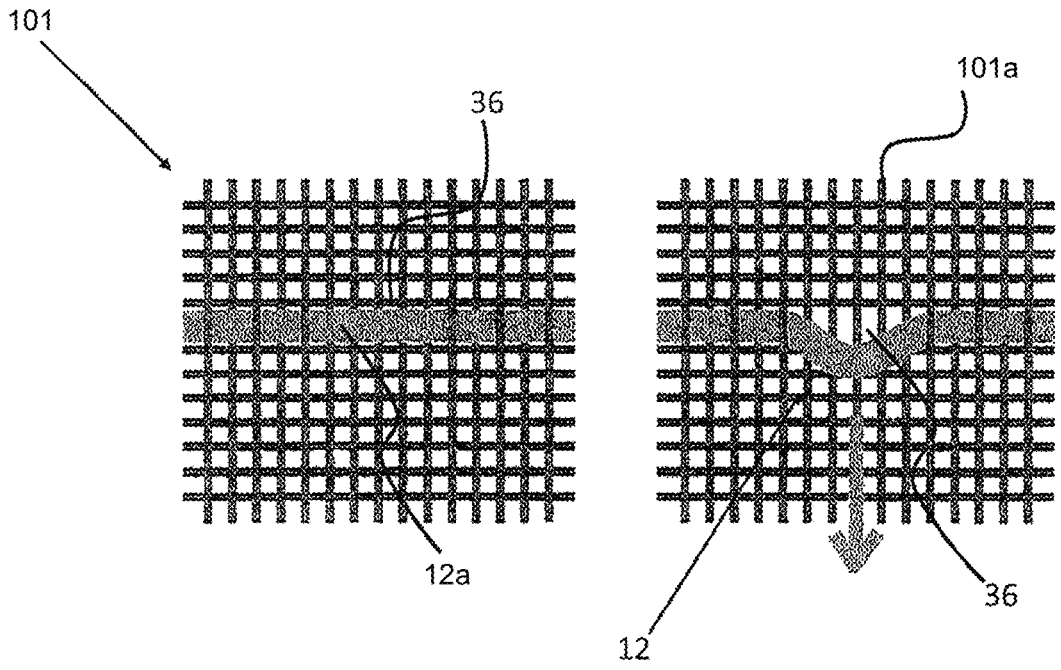
FIG. 4 a close up on a closing mechanism of an exemplary bag.

FIG. 1G shows a bag dispenser system in the rolled-up state in a perspective view, FIG. 2 is a perspective view of the bag dispenser system including a box according to another embodiment;

FIG. 3*a* is a perspective view of the not closed by means of the shutter mechanism bag according to another embodiment, FIG. 3*b* is a perspective view of the sealed by means of the closure mechanism bag according to another embodiment. Identification FIG. 4 shows a detail of the closure mechanism of FIG. 3.

A bag dispensing system, generally designated 10 in FIGS. 1G to 4, according to the first embodiment preferably comprises a plurality of bags 11 which are similar, each bag 11 having a closure mechanism 12 and an attachment section 13.

The bags 11 may be detachably connected to the attachment portion 13 and may be rolled up into a roll 14 which may be loaded into known roll-off systems or for a corresponding carrier may be provided.

The bag 11 may be rolled such that a lower end 15 of the last bag 11 forms the beginning of the roll. The pouches 11 are preferably at least partially apparent at an upper end 16 and closed at the lower end 15 thereof. An upper end 16 of each bag 11 may be releasably connected via the attachment portion 13 to the following bag 11 at the lower end 15 thereof.

Further, the bag 11 may also connected to the side edges that lie between the upper end 16 and lower end 15 and rolled up accordingly.

In addition, each bag 11 may include a handle hole 18 below the upper end 16 of the fixing portion 13. The hole 18 is at least partially openable, and may be located above the shutter mechanism 12.

Each bag 11 may be made of a material selected from natural fibers, especially a textile material, in particular from a braided, knitted, woven or pressed material.

As aforementioned, the bag 11 may also include a closure mechanism 12 schematically in FIG. 1G, FIG. 1H, FIG. 2, FIG. 3*a*, 3*b*, and is shown and shown in detail in FIG. 4. The closure mechanism 12 is preferably integrated in the fabric 101 of the bag 11. The closure mechanism includes a ribbon 12*a*, wherein the ribbon 12*a* is configured to extend in an alternating over-under pattern relative to the threads 101*a* of fabric 101. The ribbon 12*a* is configured to be pulled in order to close the bag 11. In addition, the closure mechanism 12 preferably has at least one engagement region 36 configured to be pulled. The engagement region may be formed by a weave pattern in which the ribbon extends over at least three subsequent longitudinal threads 101*a*. The weave pattern creates a correspondingly large gap between the introduced band 12*a* and fabric 101 so that a finger may be inserted therein. By pulling on the ribbon 12 away from the fabric 101 (or 102), the length of the ribbon 12 remaining in the fabric 101 is regulated and as a consequence, the upper portion of the bag 11, as seen in FIG. 3*b*, contracted and finally closed. The locking mechanism described above may also apply to fabric layer 102 and its corresponding threads and structure.

Another embodiment of the bag dispenser system is shown in FIG. 2. Here, the plurality of bags 11 in a box 21, which may be made of metal, cardboard or wood, or other be housed. The box 21 has an opening 19 on one of its side surfaces 20, from the bag 11 may be conveniently removed at its upper end 16.

From box 21, respectively, the uppermost bag may stand out and having an upper end 16 of the opening 19 with its lower end 15 be inserted into the next bag 11 as described below, so that after removal of the protruding bag 11 of the next bag 11 with its upper portion 16 also out of the opening 19 of the box 21 may stand out ready to use.

The bag 11 may be housed folded upon each other in the box, as shown in FIG. 2A. Two sections of the bag 11 may be folded onto each other, wherein an edge of another bag 11 may lie between these sections, so that the bag 11*th* save space, but at the same time easily removable, are housed in the box 21. The bags 11 in the box 21 may be made of a material plastic and/or natural fibers, in particular a textile material or a paper material, or a plastic fiber material hereby in particular be formed from a braided, knitted, woven or pressed material.

Figure 8:
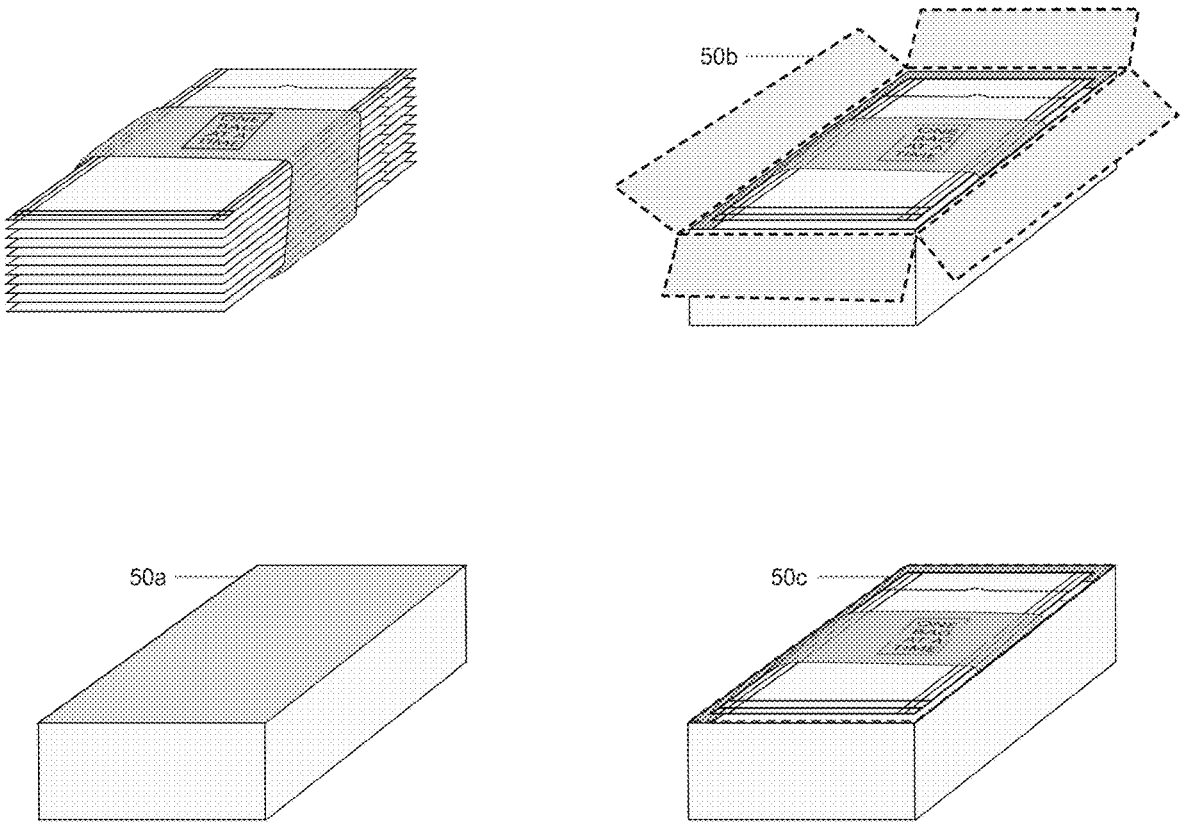
FIG. 8 shows an exemplary packaging system that may be utilized by an exemplary bag.
Figure 9:
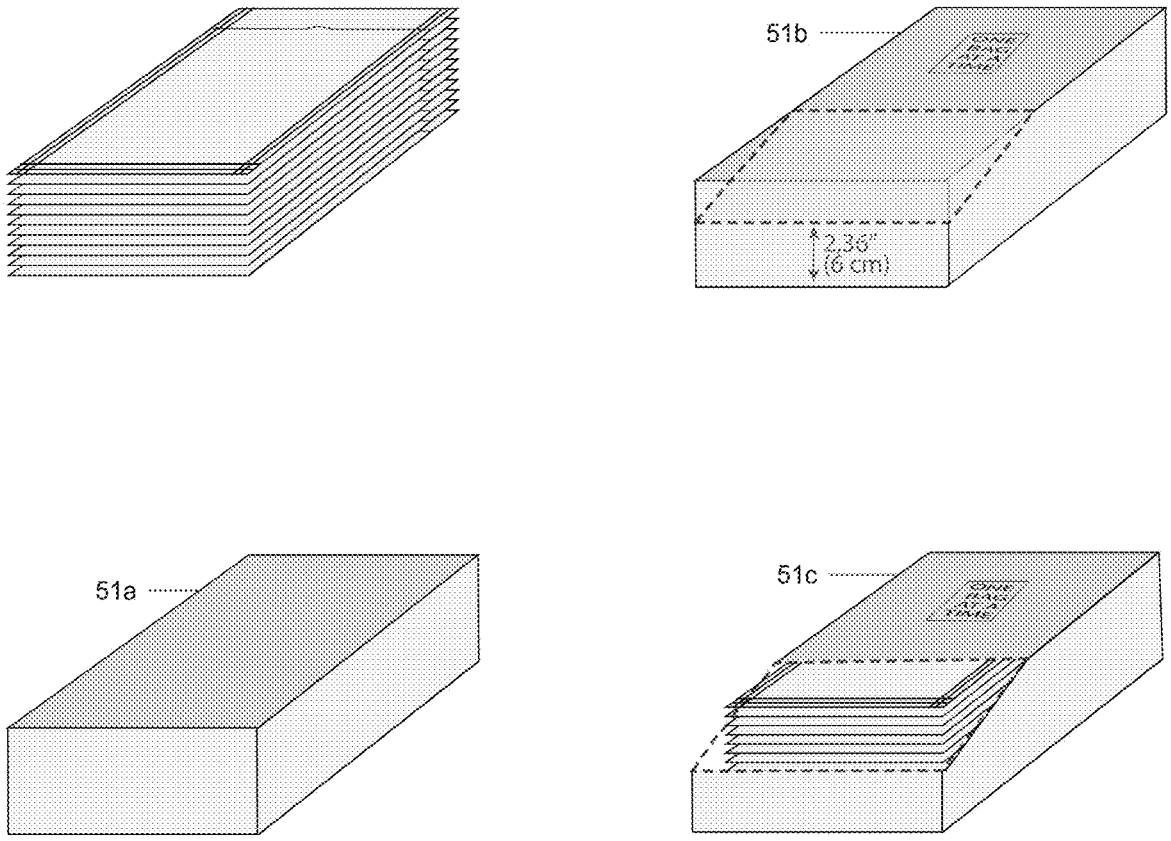
FIG. 9 shows an exemplary packaging system that may be utilized by an exemplary bag.
Figure 10:
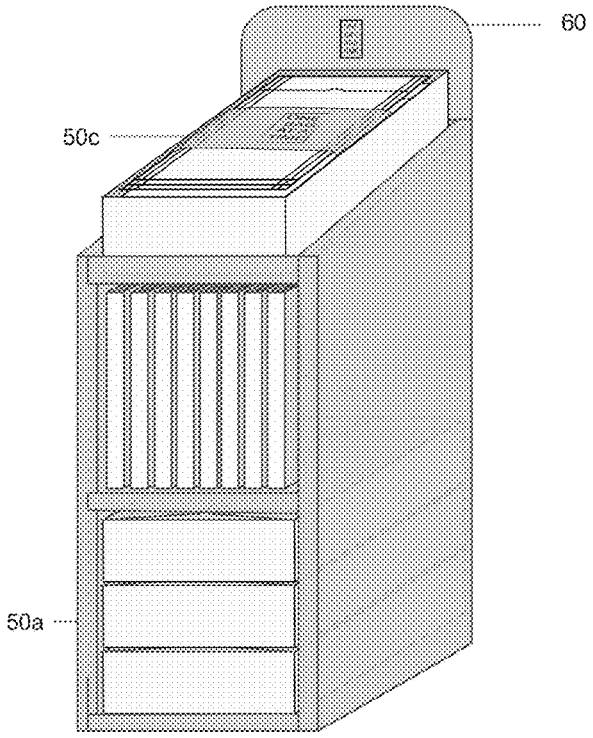
FIG. 10 shows an exemplary dispensing system that may be utilized by an exemplary bag.
Figure 11:
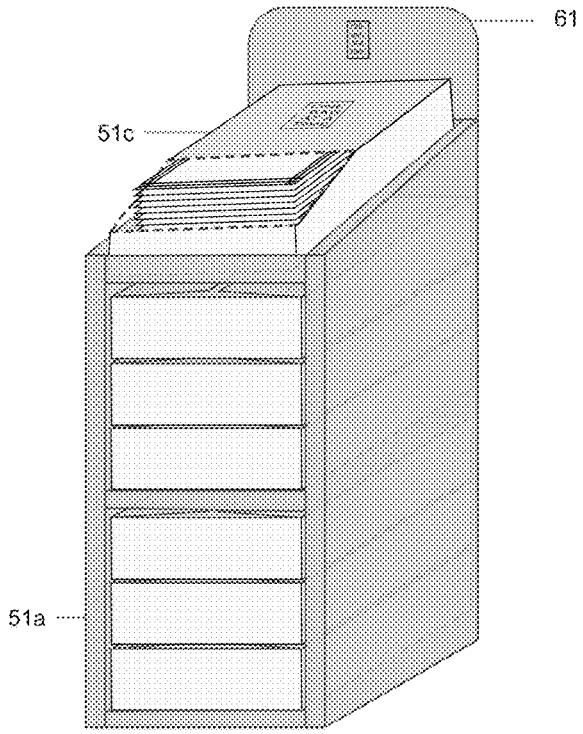
FIG. 11 shows an exemplary dispensing system that may be utilized by an exemplary bag.

Alternate housing options include those shown in FIG. 8 and FIG. 9. In these embodiments, bags 11 are stored in containers 50*a*, 51*a* that convert 50*b*, 51*b* from shipping/storage containers to dispensing containers 50*c*, 51*c* where the bags are easily accessed by the user.

FIG. 10-17 illustrate various non-limiting embodiments of stands 60, 62, 63, 64, 65, 66 provided to store and/or dispense bags 11. In some embodiments, stands 60, 61, 62, 64, 65 have shelves or cubbies 72 to store extra bags 11, merchandise, or other objects. In other embodiments, stands 60, 61 may store extra containers 50*a*, 51*a* of bag 11 and display dispensing containers 50*c*, 51*c*. In other embodiments, stands 62, 64, 65, 66, 67, 68, 69, 70 include a dispensing section where bag 11 is readily accessible to the user. In other embodiments, such as stands 64, a second dispensing section 77 is included. In the embodiments illustrated, the dispensing section is open on top to allow a user to reach in and grab a bag 11. One side of the stand may include a cutout 71 to facilitate a user grabbing the bag 11. In other embodiments, the dispensing section is similar to the dispensing mechanism as illustrated in FIG. 2.

Figure 12:
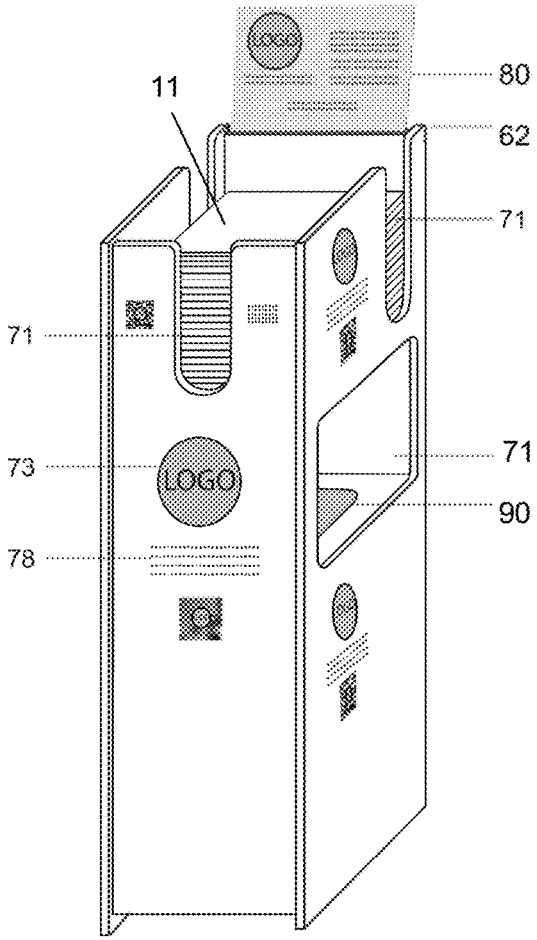
FIG. 12 shows an exemplary dispensing system that may be utilized by an exemplary bag.
Figure 13:
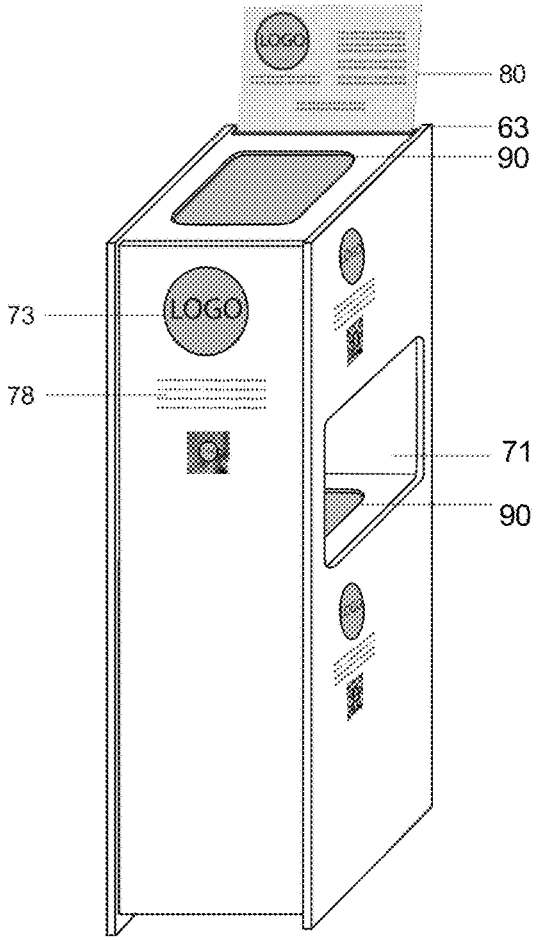
FIG. 13 shows an exemplary dispensing system that may be utilized by an exemplary bag.
Figure 14:
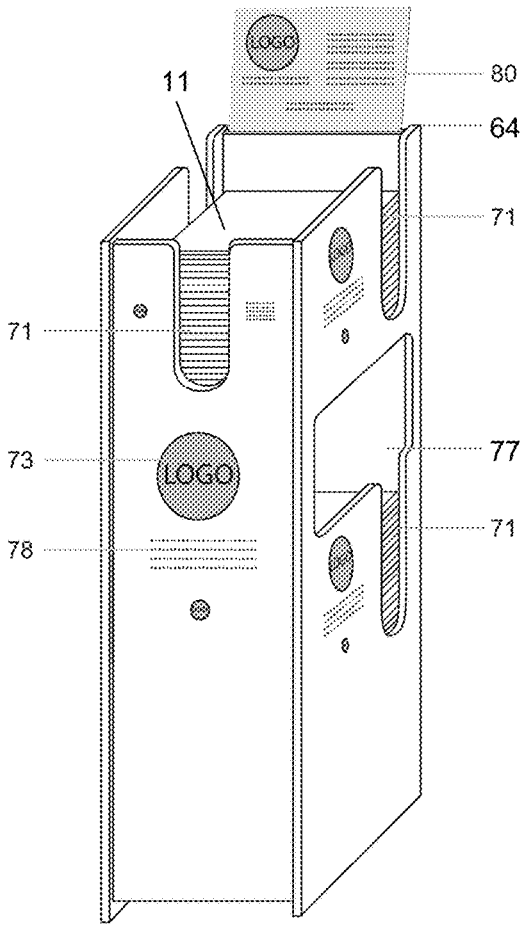
FIG. 14 shows an exemplary dispensing system that may be utilized by an exemplary bag.
Figure 15:
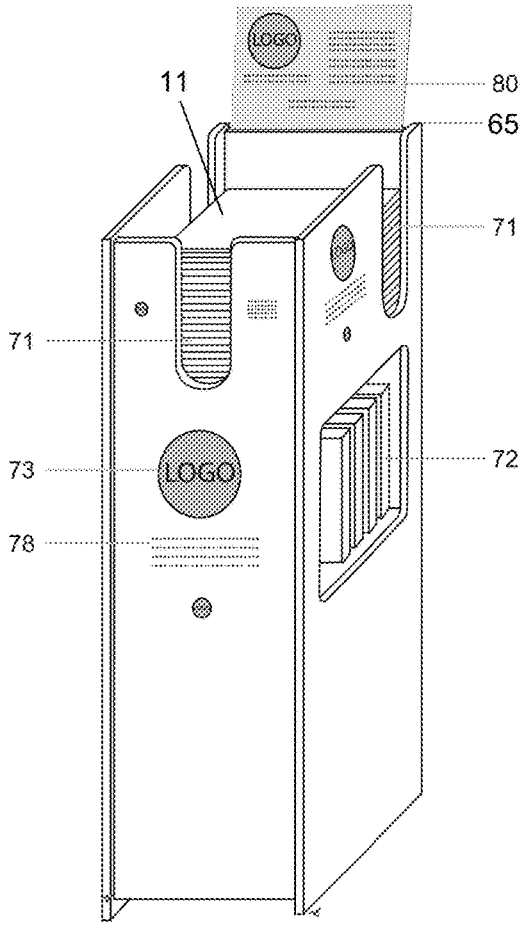
FIG. 15 shows an exemplary dispensing system that may be utilized by an exemplary bag.
Figure 16:
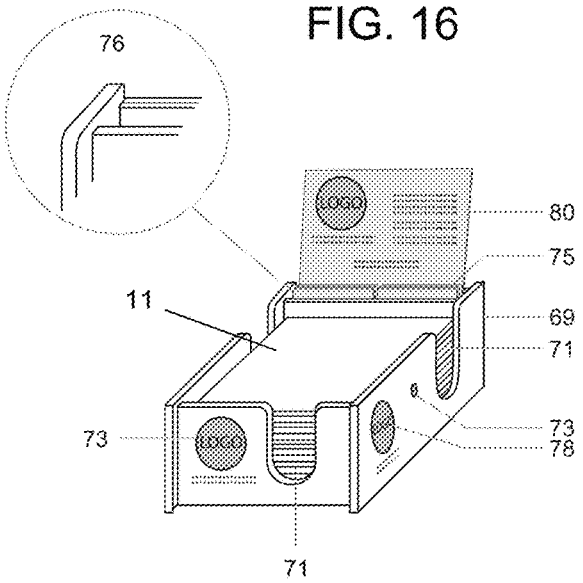
FIG. 16 shows an exemplary dispensing system that may be utilized by an exemplary bag.
Figure 17:
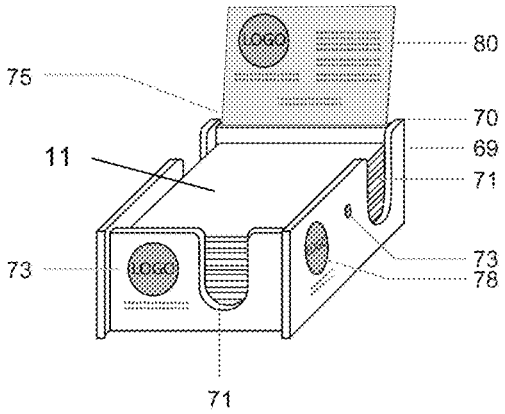
FIG. 17 shows an exemplary dispensing system that may be utilized by an exemplary bag.

FIGS. 12 and 13 illustrate stands that include a recycling or upcycling disposal portion 90 configured to be disposal units for a discarded bag. The disposal portion 90 may be included at two levels as shown in FIG. 13. A cutout 71 may be provided in order for users to dispose unwanted bags into the disposal portion 90. A recycling system utilizing the disposal portion 90 will be described further below.

The stands may include a logo 73 or other advertising 78 placed in various locations on the stand. Often the stands include a storage slot 76, which may hold brochures, flyers, newsletters and the like. The stands may also include a placard 80. In the embodiments illustrated, placard 80 attaches to the stand via groove 75.

The bag 11 may be made of a material that is semi-transparent, as described above. As may also be seen in FIGS. 1-4. Also, for example, the bags 11 may have an identifying mechanism 23 which may be bar code/dot code (QR Code/Barcode RFID technology or other) that is be applied to the bags 11 with an environmentally degradable ink. The identifying mechanism is designed to ensure that each of the bags 11 is preferably food safe and may provide unrestricted transport and storage of food. In addition, each bag 11 may be tear resistant, which allows the bag 11 with a variety of foods or the like to fill and transport. The bags 11 are formed in a further embodiment of a single material web. The material web may be made from a hose, which may be hemmed at the upper end 16 and the lower end 15, be formed, so that a bag-like structure is formed.

Figure 18:
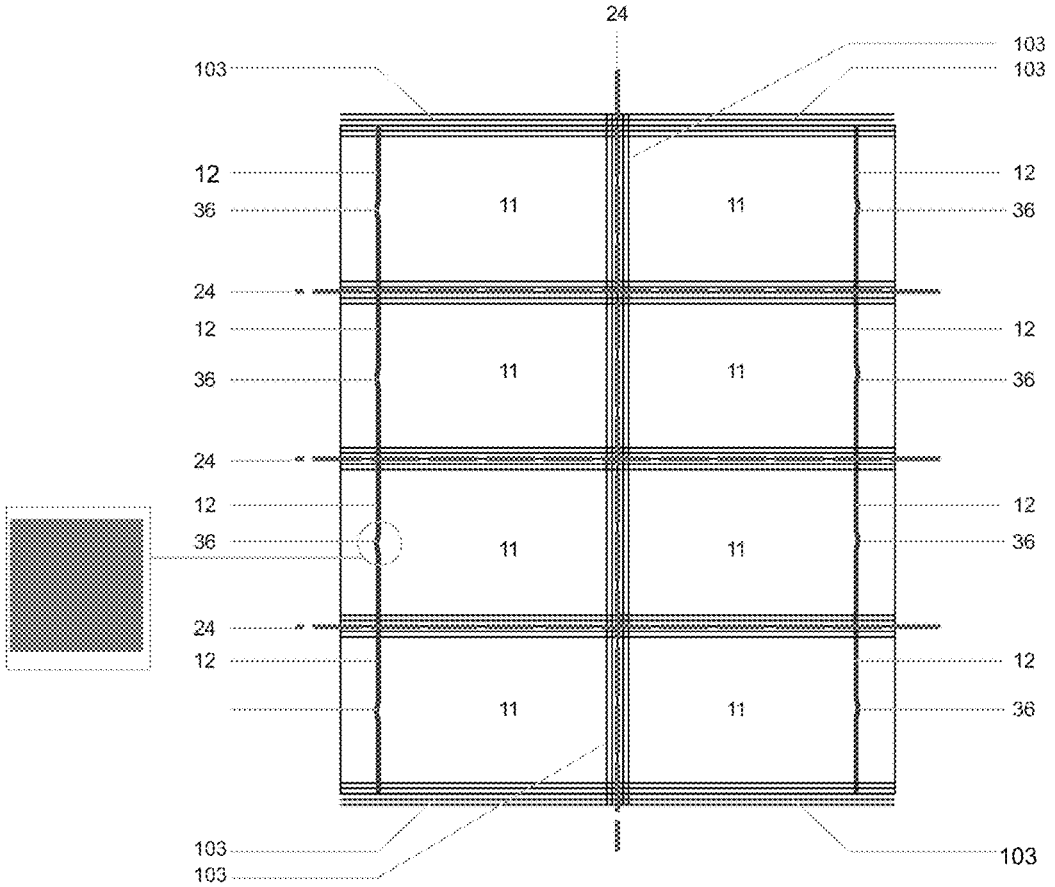
FIG. 18 shows an exemplary manufacturing system for a plurality of bags.

In a further embodiment, the bag 11 may be formed of two layers, wherein at least one edge of the one part by gluing and/or sewing may be connected to one edge of the other part. In the embodiment illustrated in FIG. 18, multiple bags 11 are formed from two large layers through the use of the interwoven area 103. In the embodiment illustrated, eight bags 11 are formed from the placement of six interwoven areas 103. Select interwoven areas 103 are cut along lines 24 to produce the 8 bags. In the embodiment illustrated in FIG. 18, multiple bags 11 may be formed from two large layers through the use of interwoven areas or seams or other suitable processes for connecting two fabric layers together such as glue, welding and the like. The interwoven areas may be formed in a zig zag pattern.

FIGS. 1G-4 illustrate a bag dispensing system 10 comprising a plurality of bags 11, wherein the bags 11 are detachably connected to each other at an attachment portion 13. Each bag 11 is formed from a material of natural fibers, in particular a textile material or a paper material. The plurality of bags 11 may be rolled up into a roll 14. The bag dispenser system may include forming the releasable attachment of a perforation, a detachable bonding or a detachable seam.

A bag dispensing system 10 may include a plurality of bags 11, wherein the bags 11 are each folded such that two portions of the bags 11 are folded together and one edge of another bag 11 lies between these sections, wherein each bag 11 made of a material of natural fibers, in particular a textile material or a paper material, and/or of plastic material, in particular a plastic fiber material is formed. The plurality of bags 11 may be housed in a box (1 made of metal, cardboard or wood. The bag 11 may be provided with a grip hole 18. At least one edge of the bag 11 may be provided with a seam 22 made of natural fibers. The bags 11 may be semi-transparent.

The bag 11 may have an identifying mechanism 23 which may be a barcode/point code applied with ecological ink. In some embodiments, a logo 25 may be printed on the bag. In other embodiments, bag 11 may have a chip 23 as the identifying mechanism as illustrated in FIG. 1. The chip 23 may be known methods of RFID tagging or RFID chips, capable of broadcasting data upon receiving power from a RFID reader or the like. The identifying mechanism may also be activated through electric impulses via the reader and then transmit data/information back to the reader. The bag may also be monitored using the identification mechanism. The bag may be tracked via multiple sensor systems such as optical sensors, RFID sensors, in order to track the motion of the bag. The tracking system may be implemented in stores utilizing the bag. Using the tracking system the store may track inventory of the bag and various other data that may be used by tracking the bag in the store. The system provides real time data for the store or for any other users of the tracking system.

The bag 11 may be food safe. The bag 11 may be tear-resistant. The bag 11 may consist of a single one material web is formed. The bag 11 may be formed of two layers is and at least one edge of the one part is connected by gluing and/or sewing with an edge of the other part. The bag 11 may consist of a braided, knitted or woven material is formed. The bag 11 may consist of a pressed material is made. The bag 11 may be formed in one rectangular shape. According to another embodiment, bags 11 of a braided, knitted or woven material, in particular bags a bag dispensing system 10 according to any one of the preceding claims, wherein the bag 11 comprises a closure mechanism 12 comprising a ribbon 12*a* introduced into the fabric 101 (or 102), the ribbon 12*a* being alternately under at least one warp thread 101*a* and pulled over at least one adjacent warp thread 101*a*, wherein the closure mechanism 12 at least an engaging portion 36 formed by a weave pattern in which the ribbon 12*a* is under each of a first warp thread 101*a* pulled and pulled over at least three subsequent warp threads 101*a*.

Figure 5:
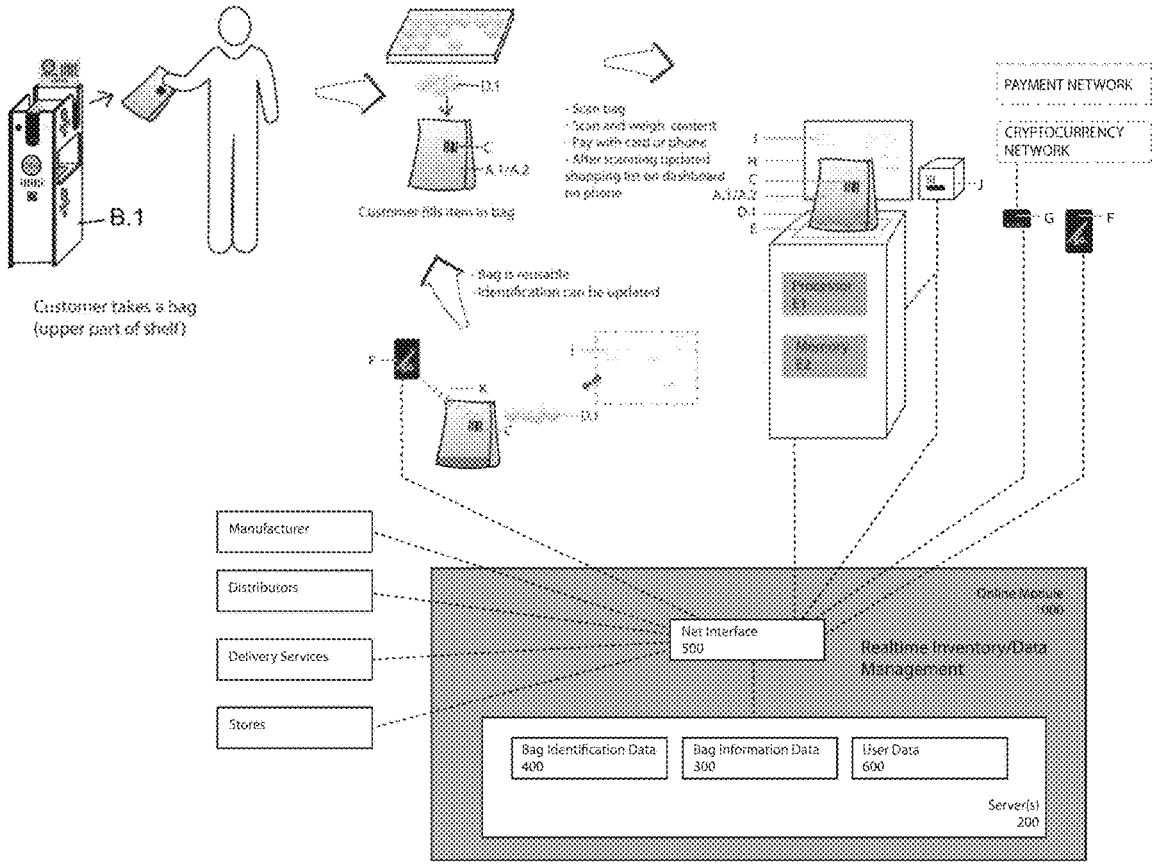
FIG. 5 shows a system and network that may be utilized by an exemplary bag.

A unique system may be utilized with the bags above. As shown in FIG. 5, for example, the system provides for use of a sustainable alternative to those systems and bags in use today. A bag A.1/A.2 is reusable, compostable, up-cyclable, recyclable or biodegradable. The bag A.1/A.2 as shown may be any bag embodiments shown above (e.g., bag 11 as shown in FIG. 1). The bags A.1/A.2 may be placed in a folded position in a standing box B.1, smaller box (not shown), or in a hanging box (not shown) attached to a wall, and/or on a roll (not shown) where the bags are tearable/severable. On the bags includes identifying mechanism C (or 23 as shown in FIG. 1) attached/integrated with weaving, ecology-friendly ink or other technology to the bag. The identifying mechanism C/23 may be integrated into or on the bag via any of the following methods: gluing, ironing, interweaving, printing, knotting, stitching, welding, etc. The identifying mechanism C may utilize a barcode, QR code, or the like. The system allows the replacement/reduction of plastic and/or paper packaging of any groceries and other goods in stores. In one embodiment, the identifying mechanism C attached/integrated in the bag A.1/A.2 enables the accessibility of updated product information I of the bag A.1/A.2 and the goods D.1 inside, presented on any electronic device F (mobile device, laptop, computer, sensors, RFID readers, etc.). The identifying mechanism 23 as shown in FIG. 1 or C as shown in FIG. 5 may be a chip attached/integrated on one side of the bag. The chip may be pre-programed or programmable. The chip 23 may be an RFID microchips or any other microchips capable of sending and/or receiving data.

There is an increasing likelihood that various regulations and statues will limit the use of plastic wherever plastic may be replaced through environmentally friendly products. The present disclosure describes provides a system that allows for entirely new store concepts such as, for example, environmentally friendly bags, bag driven automated payment (without cashier) and additional service and information up to date provided to the consumer at any time based on information provided and/or acquired through the use of the bag and its embedded identifying mechanism.

While some aspects disclosed herein may exist in part, the innovative combination described herein does not exist as a solution to providing an environmentally friendly solution to the use of bags for shopping.

Environmentally friendly "bring your own bag" stores already exist. The customer brings bags or vessels or container (plastic, metal, glass etc.) and pays per weight or amount at the cashier. A cashier is needed for these stores. Since the customer brings his own bag and he/she fills these bags or vessels (plastic, metal, glass etc.) the customer has limited information about the products (ingredients, expiry dates, place of origin . . . ). However, background information is more and more important to the consumers.

We live in a time where a whole society experiencing a sky rocketing amount of people having food related health issues (food allergies, chronicle illness, obesity, diabetes, . . . ). In the future, it will be become more and more important to the consumer to have more control over what they eat and where the food comes from. Transparency will be one of the key factors in the food and product industry. Retailers and manufacturers will need to provide their clients and customers with a transparent and clear product information—anytime, everywhere accessible.

There are already stores currently existing that offer the service of automated payment (without cashier). For example, Amazon and Target offers this service in some stores. At Amazon for example, the customer is filmed in the store and the amount of his purchase will automatically been drawn from his account. However, existing retail stores do not yet solve the problem the world faces with environmentally unfriendly and potential unhealthy packaging. Further, no retail stores link the use of environmentally friendly packaging with information sharing and automated payment.

Some products (food or other industries like clothing) already offer the full information about the product and react to the growing demand of the "story" behind a product. In many cases, the story does not include the packaging or any other environmental aspect. The information is imbedded to the product or its package and shows any information that was printed or applied at a certain time to the package or the product.

Each bag A.1/A.2 has an identifying mechanism C/23 printed or through any other technology imbedded/integrated. When filling the customized amount of groceries or other goods D.1 into the bag, it will be weighted via local module E and the bag A.1/A.2 will be scanned via local module E right away at every aisle where the product D.1 is been filled. The customer is able to see all product information I right away at a display H. The barcode C (QR Code/Barcode RFID Technology or other) will be registered online. With this identifying mechanism C associated is now its product D.1 in the bag A.1/A.2 with all needed information I (e.g. weight, expiry date, ingredients, manufacturing, design, sourcing and any other background information). This information is always updated. The information I is not at the product but available at an online module 1000. The online module may comprise one or more physical servers 200 configured to store data associated with the system. The product information I may be stored in a bag information data 300, where the bag information data 300 is stored in the online module.

A bag identification data 400 may also be stored in the online module. The identifying mechanism may comprise the bag identification 400 data (e.g. numerical data represented by the barcode, or data sent by an RFID microchip). User data 600 may be linked or associated with the identification data in order to assign the bag to the owner or user of the bag. The user data may include personal information of the user or owner of the bag. Bag information data 300 is also stored in the online module in the servers 200. The bag information data 300 and the identification data 400 may be accessed online via electronic device F via net interface 500. The net interface 500 is configured to communicate with the servers 200 of the online module and its data and any communications to other electronic devices F external to the online module such as mobile devices (smart phones), laptops, computers, and any other devices capable of connecting to a network or the internet. An application or app may be provided for these electronic devices F in order to communicate with the online module. The online module 1000 includes at least one or more servers comprising data. The online module includes an online website/page is created for each bag and its content accessible via net interface 500. User data 600 may only be accessed by the associated user and may be downloaded by the associated user.

The local module E communicates with the online module 1000 via net interface 500. Local module E includes a CPU E1 and memory E2. The processor E1 is a hardware processor, such as a single core or a multicore processor. For example, the processor E1 comprises a central processing unit (CPU), which may comprise a plurality of cores for parallel/concurrent independent processing. In some embodiments, the processor E1 includes a graphics processing unit (GPU). The processor E1 is powered via the power source and is coupled to the chassis.

The memory E2 is in communication with the processor E1, such as in any known wired, wireless, or waveguide manner. The memory E2 comprises a computer-readable storage medium, which may be non-transitory. The storage medium stores a plurality of computer-readable instructions for execution via the processor E2. The instructions instruct the processor E1 to facilitate performance of a method for automated turn signal activation, as disclosed herein. For example, the instructions may include an operating system of the vehicle or an application to run on the operating system of the vehicle. For example, the processor E1 and the memory E2 may enable various file or data input/output operations, whether synchronous or asynchronous, including any of the following: reading, writing, editing, modifying, deleting, updating, searching, selecting, merging, sorting, encrypting, de-duplicating, or others.

The memory 106 may comprise at least one of a volatile memory unit, such as random access memory (RAM) unit, or a non-volatile memory unit, such as an electrically addressed memory unit or a mechanically addressed memory unit. For example, the electrically addressed memory comprises a flash memory unit. For example, the mechanically addressed memory unit comprises a hard disk drive. The memory E2 may comprise a storage medium, such as at least one of a data repository, a data mart, or a data store. For example, the storage medium may comprise a database, including distributed, such as a relational database, a non-relational database, an in-memory database, or other suitable databases, which may store data and allow access to such data via a storage controller, whether directly and/or indirectly, whether in a raw state, a formatted state, an organized stated, or any other accessible state. The memory E2 may comprise any type of storage, such as a primary storage, a secondary storage, a tertiary storage, an off-line storage, a volatile storage, a non-volatile storage, a semiconductor storage, a magnetic storage, an optical storage, a flash storage, a hard disk drive storage, a floppy disk drive, a magnetic tape, or other suitable data storage medium.

The display H may be configured to display the bag identification data 400 and bag information data 300. The display may be connected to the processor E1 and memory E2. The display may also be connected to the online module. The bag information within the online module is certified and guaranteed by users of the online module or manufacturers of the product associated with the bag information. Certifications and guarantee standards are similar to GOTS in already existing for the textile industry. Manufacturer of the item D.1 may be connected to the online module. Each product D.1 may include a webpage included in the online module 1000 accessible via various electronic devices through the net interface 500. The manufacturer may have full access to the webpage of the item D.1, allowing the manufacturer to edit and configure item information about the item D.1. A bag webpage may also be included in the online module 1000. Each bag having the identifying mechanism may be associated to editable webpage which may be overwritten, exchanged by the user of the bag. Items stored and scanned into the bag are registered into the webpage. Item information may also be included in the bag information data 300. The bag information data may include at least one of product weight, price, expiry date, ingredients, manufacturing method, source, carbon footprint, ingredients, location and nutrition facts. Multiple different items may be stored and registered to a single bag via local module E. The bag information data will include the multiple items listed and stored in the webpage of the bag. A shopping list may also be stored in the user data 600 and configured to be editable and accessed via the electronic device F. As the user purchases or scans the item D.1 through the local module E, the shopping list may be updated in order to notify the user of the bag that the item has been addressed.

Various other entities may also be connected to the online module such as distributors, delivery providers of the item D.1. The online module may also be connected to and incentivized by, local government, state, government, banks, and insurance companies. The user data 600 may also include a purchase history comprising all purchases associated with the user of the reusable bag. The user data 600 may also include user location. User data may collected and utilized by manufacturers, distributers, and/or stores. User data 600, bag information data 300, and bag identification data 400 may be collected and transparently used for eco-friendly (local) planning, expansion or used to adopt growing or degreasing demand or to reduce traffic and waste. User data 600, bag information data 300, and bag identification data 400 may be used to inform, educate the users or various entities. Different trends may be studied and utilized in order to provide the most efficient system. User data 600, bag information data 300, and bag identification data 400 may also be used to reduce storage space and time as well as waste.

The local module E may communicate with the online module to update items inserted into the bag A.1/A.2. The local module E may modify the bag information data 300 associated with the bag A.1/A.2 to comprise a different item stored in the bag (different from product D.1/D/2). The local module may send updated data to the servers so that the bag information data 300 is modified and is now associated with the different item. Local module E may include sensors such as weight sensors in order to update the bag information data 300 which may comprise item weight, item temperature, and/or item freshness (via monitoring of gases in the bag). The local module E may accurately identify the number of the items based on the weighted or scanned bag. The local module E may send this data to the online module 1000. This allows the store to accurately track inventory. Electronic device F may also monitor bag information 300. Bag information 300 may also include store data, store location, manufacturer, distributor, and/or logistics information. This information are either provided by the local module E, or manually updated via different entities such as the manufacturer, distributor, or delivery providers.

The identifying mechanism C (or 23 as shown in FIG. 1) may be connected/integrated/interwoven to the closing mechanism 12. The chip 23 may monitor the actuation closing mechanism via sensors such as a piezoelectric sensor that may be integrated into the identifying mechanism C/23. A monitoring system utilizing electronic device F may be implemented such that the electronic device F may upload bag information data to the online module 1000. For example electronic device F may read bag information data 300 broadcasted by the identifying mechanism C (or 23), where the bag information data may also include closing mechanism data representing whether the bag has been opened or closed). The bag information data 300 may then be uploaded to the online module 1000 via the electronic device F. The bag information data 300 may include data representing the position or location of the bag which may be monitored by electronic device F. This data allows various entities such as the manufacturers, distributors, delivery services, or stores to track the location of the bag in real time. This data may provide stores with real time inventory management which can save costs and labor while optimizing inventory management. The online module may also include a history a bag information data 300 which may include the position/location data.

Bag information data may also include historical positional data such as where the user has traveled within the store and how long the user of the bag has been in certain areas or sections of the store. The store, or other entities, may also utilize this data for improving store layout by monitoring this historical positional data. The store may also utilize this information to optimize flow within the store by utilizing trends that may be present in the historical positional data. Bag information data 300 may also include item history data associated with past and current items purchased associated with the bag. This item history data may be utilized by manufacturers, distributors, delivery services, or stores in order to find trends for items.

The online module may also include community data such as a wiki of different products associated with the bag A.1/A2. The wiki is editable by various entities including but not limited to customers or users of the bag, manufacturers, distributors, and delivery providers associated with the products configured to be stored in the bag. This allows the item information to be transparent and be always up to date. The online module net interface 500 which includes a dashboard or a user interface in which various entities may interact and connect to in order to access various data such as the product information. The net interface 500 also allows various entities to interact through forums and receive news feeds provided in the online module 1000. The online module also provides users a platform to interact, exchange, inform, gather information and news, recipes, and trends. The online module may provide an exchange forum where the users may trade and sell various items. The online module may also include a specific product forum where specific products may be discussed with various users and entities. This forum allows manufacturers to interact and receive feedback from the users. The online module may also include an algorithm (e.g. any known personalized advertisement algorithms) configured to provide curated advertisements to the various entities connected to the online module 1000. The algorithm may provide advertisements to local products and stores. Preferably the stores may stores that promote a sustainable and green ecosystem. A crypto currency network may also be connected to the payment module G in order to allow the user to pay via various crypto currencies. The identification mechanism C may also provide the owner or user of the bag with memberships to exclusive stores that require a subscription or a membership to enter.

The user may either pay immediately at the check-out with the cashier who scans the bag(s), or the customer may check in with the electronic device F and pay via a payment module G associated with the user. The payment module G may include a payment method/system that is utilized by the user such as a credit card or an internet payment method such as bank wires or transfers. A card reader/scanner J may also be located beside local module E and may be connected to local module E and online module 1000 via net interface 500. Card reader/scanner may also be integrated into module E. The payment module may be connected to the online module 1000. The local module E may be connected to a payment network allowing the user to pay with the payment module using local module E to pay for items D.1. The payment module G may also be connected to the electronic device F, allowing the user to pay for the items D.1. This allows for the possibility for cashier free stores. By scanning the bag A.1/A.2 at local module E the buyer may access the bag identification data and bag information data through the display H of the local module E at any time.

The bag information data may include the price of the items in the bag. The price of the items may also include the bag itself if the bag has not been purchased. The customer or user is the owner of the bag A.1/A2 and the goods inside D.1. Only the customer has access to the bag and product information through scanning the identifying mechanism C or sign on to his/her account in the online module with his/her personal safety password. The user buys the bag A.1/A.2 and can, to his liking reassign the barcode C to any other product by scanning via local module E a new good at the store. The quality of the bag A.1/A.2 allows multiple usages. The information of each purchase will be saved to the online module. Users of the bag A.1/A.2 may also provide feedback to the manufacturer through the online module via the webpage of the associated item D.1. The bag and its system provides users with an ecosystem and infrastructure for crypto currency and local currency. This ecosystem may offer local trade benefits. The described system leads to a reduction of labor cost/time through real time & automated payment and check-out options via the payment module G, local module E, and electronic device F. Employees of the store are not required to be present at checkout of the bag, and are potentially only counting or monitoring the bags being scanned.

The customer or user of the bag may save and review all shopped items via the purchase history stored in the user data 600. The customer may utilize the online module to re-order products, as the online module is also connected to local groceries stores, manufacturers, and distributors and request a customizable packaging for the customer next order. The customer may create lists and analyze shopping habits (the sum of certain ingredients, the total carbon footprint of his products, total carbon footprint utilized by the user, total money spent, etc.). The customer may connect this information to his personal budget planning and request optimization proposals of what to buy, when and where in order to achieve a specific goal. A goal could be financial target, living healthy or ensuring a certain diet. The advantage of this transparent and readily available information will be a tremendous support to the customer in his effort to live in a generally healthier and better lifestyle. The customer may send orders to the product holder (e.g. manufacturers, distributors, or stores) with customizable packaging. That is the customer may choose the packaging in which the order comes in.

The customer may also customize the order by having the option to select the source of the item. Other customizable elements may include, product amount, product quality, weight, origin, carbon footprint, etc. The product price will vary depending on the attributes of the elements of the product chosen by the customer. For example, a lower product quality will result in lower prices. The customer may also choose the amount of days in advance to receive the goods relative to an expiration date of the item. For example, the user may set a lower amount of days from expiration if the quantity of the item is low, or if the customer expects to use or consume the item immediately. This allows the user to order and receive an item with a lower price. The price of the product will be adjusted according to the amount of days in advance. A lower amount of days allows products closer to the expiration date to be provided at a lower cost. This ensures effective distribution of perishable items and minimizes wastes of unused products. The customer may also order expired items via this system.

The online module 1000 may also provide an auction system for items provided by the product holder. The online module 1000 may also include an algorithm to provide the customer with tailored orders. The online module 1000 may also include a filtering system configured to sort and filter items for the customer. The customer may also customize orders with a reoccurring or subscription based system to receive the item at certain time periods (e.g. monthly, yearly, biweekly, weekly, etc.). This ordering system enables users to order, via the online module, from any service or product provider with focus on healthy, environmentally friendly production, efficiently delivery, good waste management, and recycling friendly.

Through the online portal, it's also possible to send direct feedback to the supplier about the product. That allows direct communication between supplier and end customer, which is valuable for the supplier and may be rewarded through lower prices.

Figure 7:
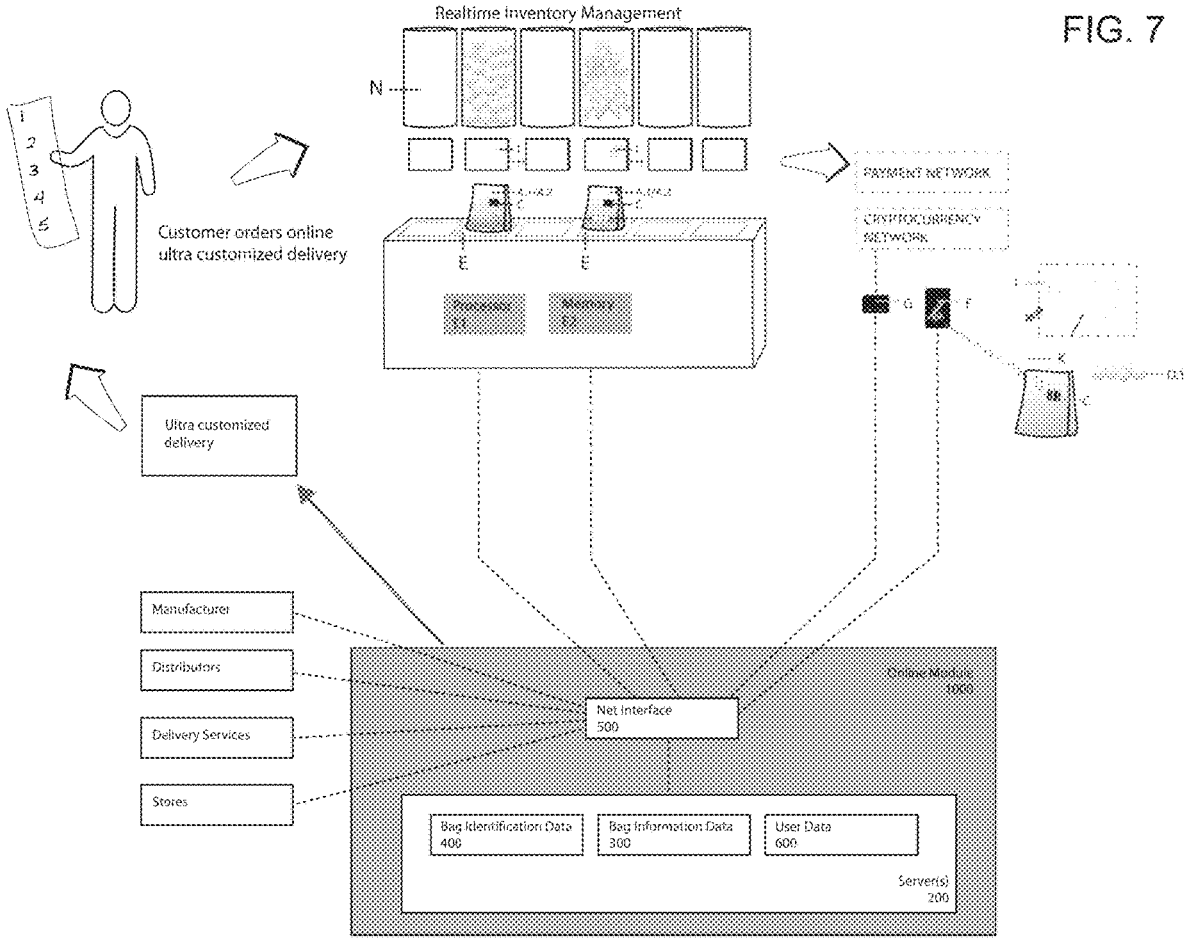
FIG. 7 shows a highly customizable ordering system that may be utilized by an exemplary bag.

As shown in FIG. 7 and described herein relates to order and delivery. Environmentally friendly bags for customized prepackaging and advanced and eco-friendly delivery concept.

The assumption is that users change their shopping behavior continuously and order from home and request automated and customized orders (for example they customize the exact amount and weight . . . ). The bag A.1/A.2 enables one-off standard packaging either from the manufacturers or from the distributors or local supermarket/store. Bag A.1/A.2 may replace the paper and/or plastic envelops for packaging and shipping as well as the environmentally unfriendly product packages.

A bulk distribution for food already exists in supermarket today. The idea is to extend this concept to stores and manufacturers, logistic companies and distributors. There may be weight, scanner and pay options under each tube with goods. This reduces the time for filling, packaging and paying tremendously. This concept may improve the whole handling process in supermarkets and as well distributor and manufacturer.

Depending on the goods delivered, the bag A.1/A.2 (multi-use use textile, natural and/or semi-natural and/or artificial fiber) may be impregnated with healthy and/or environmentally friendly waxes or oils or otherwise. Bag A.1/A.2 may be sealed so that the user may be assured of the purity, safety and quality of his products. Environmental sealing needed to be developed. Through scanning the barcode C user may receive product, delivery, packing-or any other information I stored in bag identification data or bag information data. The new bag reduces consumer waste, and offers an advanced service and customized shopping to each individual needs and timing. Since the supplier is not anymore pre-packaging his goods, the supplier reduces packaging material and costs, manufacturing and logistic costs. The disclosed embodiments reduce the overall trash and plastic problem associated with conventional bags. The disclosed embodiments may improve availability, service and price for the consumer and shipping and reduce storing costs for the stores and supplier. Wherever the product with all preset attributes is available within the shortest distance and within the shortest amount of time, will be the source of delivery.

The consumer may customize and preset his order to a new level. Since all information on all products is available and transparent he/she may set preferences to: only locally soured products should be delivered, only fair traded, only certified in certain way. The consumer may define timing and delivery regarding the durability: how many days in advance he/she likes to receive goods before they expire. The consumer could, for example, choose only one day left or the final day of usage at delivery day. The price of the product would adjust accordingly. Thus, the consumer could practically auction the good. The consumer has the choice to purchase certain goods even of the expiration date of the goods has past. The price depends on the demand. The result will be that much less products will be wasted and the production of goods will be designed to be flexible and to short notice consumer demand. Thus the system shown in FIG. 7 allows a very specific customizable service (e.g. ultra customized orders and deliveries) tailored for the user.

Figure 6:
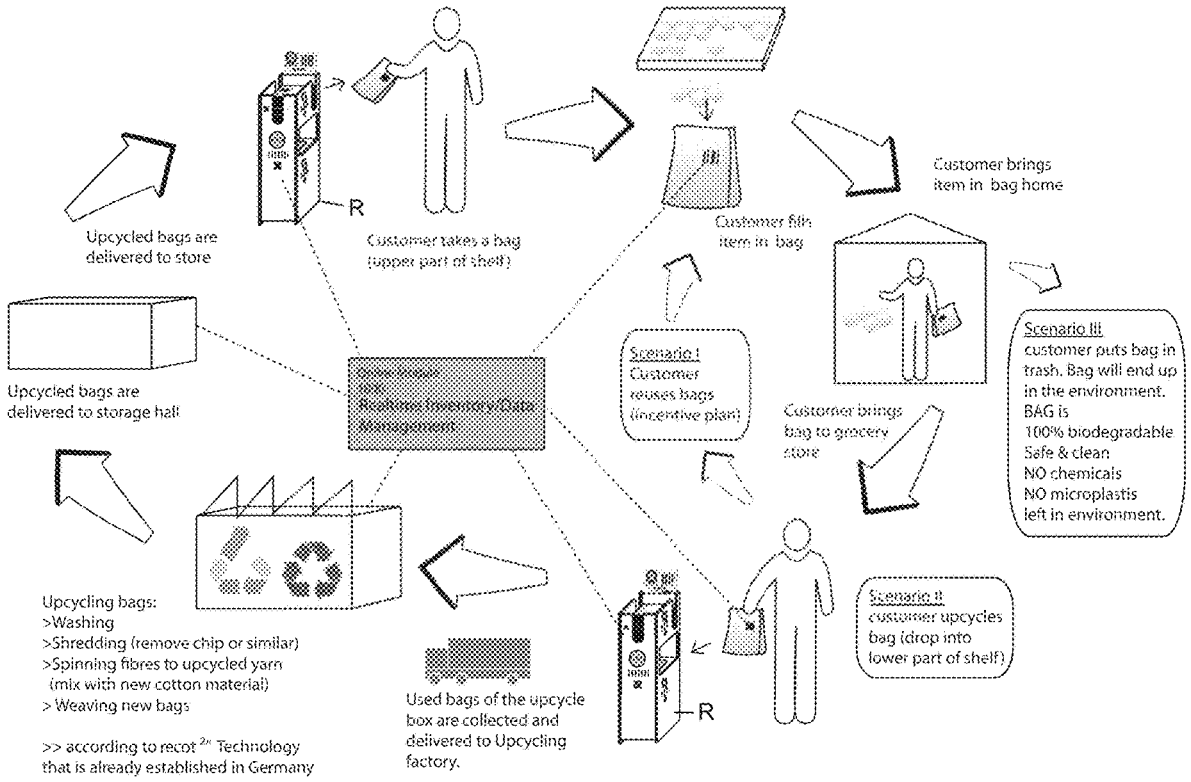
FIG. 6 shows a recycling system that may be utilized by an exemplary bag.

FIG. 6 shows a recycling system that may include a recycling structure R configured to be connected to the online module 1000 as shown in FIG. 5. The recycling system shown in FIG. 6 may include known upcycling and recycling processes such as Recot²® established in Germany. The recycling structure may also be provided and integrated onto local module E. Recycling structure R may be stands 62/63 as shown in FIGS. 12 and 13. Recycling structure R and provides the user of the bag to recycle or upcycle the reusable bag. The local module E or recycling structure R may communicate with the online module to provide rewards, via the electronic device, to the users of the associated reusable bags discarded and received by the recycling structure R. The recycling structure R may also include a scanner wherein the scanner is configured to scan discarded bags in order to read the identifying mechanisms in order to identify the owner or user of the bag. If the user or owner cannot be identified the user may manually enter the account associated with the bag in order to receive the rewards for disposing the bag.

Incentives and rewards may include for example, users that have utilized the recycling structure at least once may take part in monthly or yearly sponsored events/prices organized and sponsored by a store associated with the bag. When the user has used the recycling box three times, for example, the user may receive free audio book either for adults or kids about sustainability through an application of the electronic device connected to the online module. When the user has utilized the recycling box ten times, the user will be paid back the full amount of bag. When the user has utilized the bag for example twenty times, the bags will be collected for upcycle/recycle and participate in monthly or yearly lottery. Prices are either the participation in a yearly lottery or the invitation to a local program. The local program may be a one day (family) workshop locally hold either at organic farms or other partners who sell organic and locally produced sustainable and environmentally friendly goods (companies like No Tox Life, Hess Natur, etc.). The program shares and teaches newest developments of sustainable and plastic free living. Other partners could be local and organic partners of the supermarket where the bag is offered.

Other container materials may be used instead of the bag described above. For example, glass or any other recyclable materials. Any combinations of the described embodiments above are combinable or usable together.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the bag and bag system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

Certain embodiments are described herein as including modules. Modules may constitute either software modules (e.g., code embodied on a machine-readable medium or in a transmission signal) and/or hardware modules and/or any combination of hardware/software systems. A hardware module may be a tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired) or temporarily configured (e.g., programmed) to operate in a certain manner and/or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules may provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses) that connect the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation, and store the output of that operation in a memory device to which the module is communicatively coupled. A further hardware module may then, at a later time, access the memory device to retrieve and process the stored output. Hardware modules may also initiate communications with input or output devices, and may operate on a resource (e.g., a collection of information).

The various operations of example methods described herein may be performed, at least partially, by one or more processors, as described above, that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the system and methods described herein may be at least partially processor-implemented. For example, at least some of the operations of a method may be performed by one or processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

Network connections as shown as dashed lines in the figures may include channels for the transmission of data may include storage media of all descriptions as well as signal-carrying media, such as wired or wireless signal-carrying media. Software may accompany all recited modules described above as a computer program product for use with a computer system. Such an implementation may comprise a series of computer-readable instructions either fixed on a tangible medium, such as a computer readable medium, for example, diskette, CD-ROM, ROM, or hard disk, or transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink-wrapped software, preloaded with a computer system, for example, on a system ROM or fixed disk, or distributed from a server or electronic bulletin board over a network, for example, the Internet or World Wide Web.

It will be clear to one skilled in the art that many improvements and modifications can be made to the foregoing exemplary embodiment without departing from the scope of the present invention.

What is claimed is:

1. A lightweight reusable bag having a storage volume for holding an item comprising:

a first woven fabric layer and a second woven fabric layer defining the storage volume, an open end, and a closed end;

the first woven fabric layer comprising a first plurality of threads and a second plurality of threads, wherein the first plurality of threads are interlaced to the second plurality of threads, wherein the second plurality of threads are configured to stabilize the first plurality of threads;

the second woven fabric layer comprising a third plurality of threads and a fourth plurality of threads, wherein the third plurality of threads are interlaced to the fourth plurality of threads, wherein the fourth plurality of threads are configured to stabilize the third plurality of threads;

wherein the second plurality of threads of the first woven fabric layer is interlaced with the third plurality of threads of the second woven fabric layer at one side of the first and second woven fabric layer;

wherein the first plurality of threads of the first woven fabric layer is interlaced with the fourth plurality of threads of the second woven fabric layer at said one side; and wherein the first and third plurality of threads are thicker towards lateral sides of the bag.

2. The reusable bag of claim 1, wherein the first plurality of threads comprises a plurality of thread pairs interlaced with the second plurality of threads.

3. The reusable bag of claim 2, wherein the third plurality of threads comprises a plurality of thread pairs interlaced with the fourth plurality of threads, wherein the thread pairs of the first plurality of threads and thread pairs of the third plurality of threads are offset.

4. The reusable bag of claim 1, wherein the first and third plurality of threads are longitudinally extending.

5. The reusable bag of claim 1, wherein the second and fourth plurality of threads are transversely extending.

6. The reusable bag of claim 1, wherein the first plurality of threads are orthogonal to the second plurality of threads, and wherein the third plurality of threads are orthogonal to the fourth plurality of threads.

7. The reusable bag of claim 1, wherein the first woven fabric layer and second woven fabric layer comprises a leno weave.

8. The reusable bag of claim 7, wherein the leno weave is located at the closed end and open end of the reusable bag.

9. The reusable bag of claim 1, wherein weave density of the first and second woven fabric layers decreases towards the center of the first and second woven fabric layers.

10. The reusable bag of claim 9, wherein the first and second woven fabric comprises a transition portion, wherein at the transition potion the weave density transitions and gradually decreases towards the center of the first and second woven fabric.

11. The reusable bag of claim 1, wherein the first and second woven fabric layer is organic and compostable.

12. The reusable bag of claim 1, wherein the first woven fabric layer overlaps the second woven fabric layer.

13. The reusable bag of claim 1, further comprising a zig-zag pattern on lateral sides of the bag.

14. The reusable bag of claim 1, further comprising biodegradable material.

15. The reusable bag of claim 1, further comprising recyclable material.

16. The reusable bag of claim 1, wherein the first and second woven fabric layer comprises at least one of cotton, or hemp.

17. The reusable bag of claim 1, wherein the first and second woven fabric is transparent, or semi transparent.

18. The reusable bag of claim 1, wherein the reusable bag is manufactured via tube or layer-band, weaving or 3D knitting.

* * * * *